US008537071B2

(12) United States Patent
Ito et al.

(10) Patent No.: US 8,537,071 B2
(45) Date of Patent: Sep. 17, 2013

(54) ANTENNA DEVICES

(75) Inventors: Tadashi Ito, Miyoshi (JP); Atsuto Okamoto, Miyoshi (JP); Tomoyoshi Motohiro, Seto (JP); Tsuyoshi Nomura, Nagoya (JP); Masahiro Hanazawa, Aichi-gun (JP); Toshiyasu Ito, Kiyosu (JP); Takeshi Miyazaki, Kiyosu (JP); Yukihisa Ueno, Kiyosu (JP)

(73) Assignees: Kabushiki Kaisha Toyota Chuo Kenkyusho, Aichi-Gun (JP); Toyoda Gosei Co., Ltd., Kiyosu-Shi (JP)

( * ) Notice: Subject to any disclaimer, the term of this patent is extended or adjusted under 35 U.S.C. 154(b) by 520 days.

(21) Appl. No.: 12/659,825

(22) Filed: Mar. 23, 2010

(65) Prior Publication Data

US 2010/0244656 A1 Sep. 30, 2010

(30) Foreign Application Priority Data

Mar. 30, 2009 (JP) ..... 2009-082558

(51) Int. Cl.
*H01Q 21/00* (2006.01)

(52) U.S. Cl.
USPC ..... 343/826

(58) Field of Classification Search
USPC ..... 343/825–827, 843, 850; 313/358
See application file for complete search history.

(56) References Cited

U.S. PATENT DOCUMENTS

| | | | | |
|---|---|---|---|---|
| 3,673,525 | A * | 6/1972 | Collins et al. | 335/132 |
| 4,783,849 | A * | 11/1988 | Muterspaugh | 455/191.2 |
| 7,145,415 | B2 * | 12/2006 | Sengupta et al. | 333/174 |
| 2006/0099922 | A1 * | 5/2006 | Yamamoto et al. | 455/232.1 |

FOREIGN PATENT DOCUMENTS

| | | |
|---|---|---|
| JP | A-6-233480 | 8/1994 |
| JP | A-2007-116515 | 5/2007 |

OTHER PUBLICATIONS

What is battery?—Deffinition from WhatIs.com.*
The Physics Classroom.*
What is battery?—Deffinition from WhatIs.com, May 2007.*
The Physics Classroom, Jan. 2012.*
Koenig et al., "Energy Selective Contacts as Ultrafast Rectifiers for Optical Antennas," Proceedings of 21st European Photovoltaic Solar Energy Conference and Exhibition, 2006, pp. 83-86, Dresden, Germany.

* cited by examiner

*Primary Examiner* — Huedung Mancuso
(74) *Attorney, Agent, or Firm* — Oliff & Berridge, PLC

(57) ABSTRACT

An antenna device is provided with a first connecting electrode, a first tunnel diode, a first antenna member and a fixed electrode. The first connecting electrode is configured to be connected to a fixed potential via a load. The first tunnel diode has a pair of electrodes. One of the electrodes of the first tunnel diode is connected to the first connecting electrode, and the other electrode of the first tunnel diode is connected to the first antenna member. The first antenna member has a conductive property and includes a first portion and a second portion. The first portion of the first antenna member is connected to the other electrode of the first tunnel diode. The fixed electrode is connected to the second portion of the first antenna member. The fixed electrode is configured to be connected to the fixed potential.

21 Claims, 15 Drawing Sheets

ANTENNA DEVICES

CROSS-REFERENCE TO RELATED APPLICATIONS

This application claims priority under Paris convention based on Japanese Patent Application No. 2009-082558 filed on Mar. 30, 2009, the contents of which are hereby incorporated by reference into the present application.

TECHNICAL FIELD

The present invention relates to an antenna device for transmitting and/or receiving light. The present invention also relates to an antenna device for receiving light and transducing a light energy to an electric energy.

DESCRIPTION OF RELATED ART

Technologies for transmitting and/or receiving light using an antenna device are required in various fields. Developments of technologies that use antenna devices, e.g., in transmission and/or reception of information, wireless transmission and/or reception of electrical power using light as a medium, and generating electrical power from sunlight, are in progress. An antenna device referred to as a rectenna, which receives light with an antenna member and then rectifies antenna current synchronized with the light with a rectifier, has been developed as one example of the antenna devices used in these technical fields.

The majority of antenna devices referred to as rectennas are current type rectennas as disclosed in Japanese Patent Application Publication No. H06-233480 and Japanese Patent Application Publication No. 2007-116515. Current type rectennas are characterized by extracting resonant current generated in the antenna member and then rectifying with the rectifier to generate electrical current.

On the other hand, an antenna device that has a different structure from that of the current type rectenna is proposed in D. Koenig and R. Corkish, "Energy selective contacts as ultrafast rectifiers for optical antennas", Proceedings of 21st European Photovoltaic Solar Energy Conference and Exhibition, Dresden, Germany, 2006, p. 83-p. 86 (hereinbelow referred to as Koenig et al.). This antenna device is referred to as a 'voltage type' hereinbelow for the sake of expediency.

FIG. 24 shows the configuration of a voltage type antenna device. An antenna device 400 is provided with an antenna element 420 that supplies electrical current to a load 460. The antenna element 420 has a metal antenna member 430, a first tunnel diode 442, a second tunnel diode 444, a first connecting electrode 452 and a second connecting electrode 454. The first tunnel diode 442 is connected between one end 432 of the antenna member 430 and the first connecting electrode 452, and is a metal-insulator-metal (MIM) tunnel diode that selectively allows transmission of hot electrons from the one end 432 towards the first connecting electrode 452. The second tunnel diode 444 is connected between the other end 436 of the antenna member 430 and the second connecting electrode 454, and is an MIM tunnel diode that selectively allows transmission of hot holes from the other end 436 towards the second connecting electrode 454. The load 460 is connected between the first connecting electrode 452 and the second connecting electrode 454. The length of the antenna member 430 in the longitudinal direction is set to ½ of the wavelength λ of the light to be received.

FIG. 25 shows the Fermi potential within the antenna member 430 when the light of a wavelength λ has been received by the antenna member 430. The horizontal axis of FIG. 25 represents the location of the antenna member 430 in the longitudinal direction, while the vertical axis represents the Fermi potential at that location. When the light of wavelength λ enters the antenna member 430, electrons alternately concentrate at both ends of the antenna member 430 in synchronization with an alternating electric field. When an electric field oriented to the right as viewed in the drawing (indicated with the solid arrow in FIG. 25) is applied to the antenna member 430, electrons concentrate at the one end 432 of the antenna member 430 and the Fermi potential of the one end 432 of the antenna member 430 rises. On the other hand, when an electric field oriented to the left as viewed in the drawing (indicated with the broken line arrow in FIG. 25) is applied to the antenna member 430, electrons concentrate at the other end 436 of the antenna member 430 and the Fermi potential of the other end 436 of the antenna member 430 rises.

When the Fermi potential at the one end 432 of the antenna member 430 rises due to the application of the electric field oriented to the right as viewed in the drawing, hot electrons that have exceeded a discrete energy level within the first tunnel diode 442 travel through the first tunnel diode 442. As a result, a loop is formed that is composed of the antenna member 430, the first tunnel diode 442, the load 460 and the second tunnel diode 444, and current is supplied to the load 460 in the clockwise direction. On the other hand, when the electric field oriented to the left as viewed in the drawing is applied to the antenna member 430, since the first tunnel diode 442 and the second tunnel diode 444 are maintained in a non-conduction state, current is not supplied to the load. As a result, the antenna device 400 shown in FIG. 24 is able to supply to the load 460 current that has undergone half-wave rectification corresponding to the electric field oriented to the right as viewed in the drawing.

Koenig et al. further proposed an antenna device 410 shown in FIG. 26. Together with a hole-selective tunnel diode 443 being additionally connected to the one end 432 of the antenna member 430, the antenna device 410 shown in FIG. 26 is characterized by an electron-selective tunnel diode 445 being additionally connected to the other end 436 of the antenna member 430. As a result, when the electric field oriented to the right as viewed in the drawing is applied to the antenna member 430, current is supplied to the load 460 through the tunnel diode 442 and the tunnel diode 444, and when the electric field oriented to the left as viewed in the drawing is applied to the antenna member 430, current is supplied to the load 460 through the tunnel diode 445 and the tunnel diode 443. The antenna device 410 shown in FIG. 26 is able to supply to the load 460 current that has undergone full-wave rectification.

SUMMARY

However, since half-wave-rectified current is generated in the voltage antenna device 400 shown in FIG. 24, a total of at least two tunnel diodes consisting of the electron-selective tunnel diode 442 and the hole-selective tunnel diode 444 are required. In addition, since full-wave-rectified current is generated in the voltage antenna device 410 shown in FIG. 26, a pair of tunnel diodes composed of the electron-selective tunnel diode 442 and the hole-selective tunnel diode 444 and a pair of tunnel diodes composed of the electron-selective tunnel diode 445 and the hole-selective tunnel diode 443 are required, thus requiring a total of at least four tunnel diodes. Thus, the voltage type antenna devices 400 and 410 have the problem of requiring a large number of tunnel diodes. The technology disclosed in the present specification provides a voltage type antenna device having a simple structure.

As shown in FIG. 25, voltage type antenna devices utilize the phenomenon in which Fermi potential rises at the ends of the antenna member. For example, as shown in FIG. 25, the voltage type antenna device utilizes the phenomenon in which the Fermi potential at the left end of the antenna member periodically rises corresponding to the periodic application of an electric field oriented to the right as viewed in the drawing. As shown in FIG. 25, although the Fermi potential at the left end of the antenna member repeatedly fluctuates up and down, the potential is constant at a location at a distance of ¼ of the wavelength λ from the left end of the antenna member. Consequently, if the portion of the antenna member where the potential is constant is fixed to a fixed portion and the left end of the antenna member is connected to a fixed potential through a load, a loop is formed between the antenna member and the load via the fixed potential, and current generated from the electric field applied to the antenna member can be supplied to the load. The use of a fixed potential makes it possible to configure a voltage antenna device having a simple structure.

DETAILED DESCRIPTION OF THE INVENTION

Figure 1:
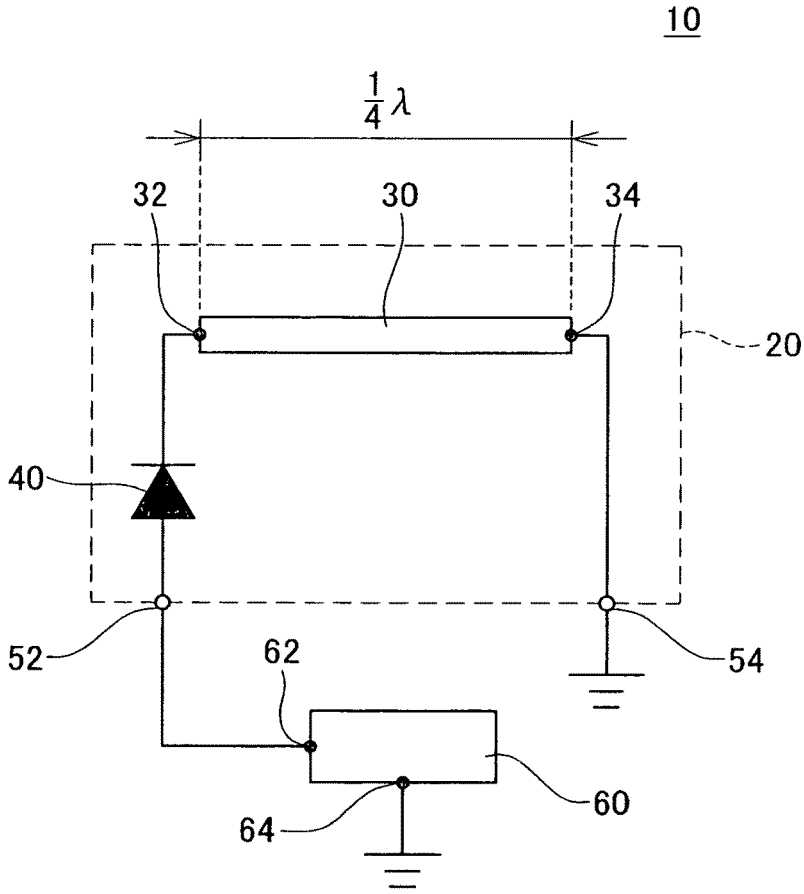
FIG. 1 shows a configuration of an antenna device of a first embodiment.

An antenna device disclosed in this specification comprises a first connecting electrode, a first tunnel diode, a first antenna member and a fixed electrode. The first connecting electrode is configured to be connected to a fixed potential via a load. The first tunnel diode has a pair of electrodes. One of the electrodes of the first tunnel diode is connected to the first connecting electrode. The other electrode of the first tunnel diode is connected to the first antenna member. The first antenna member has a conductive property and includes a first portion and a second portion. The first portion of the first antenna member is connected to the other electrode of the first tunnel diode. The fixed electrode is connected to the second portion of the first antenna member. The fixed electrode is configured to be connected to the fixed potential. In one preferred embodiment, a cathode of the first tunnel diode may be connected to the first portion of the first antenna member and an anode of the first tunnel diode may be connected to the first connecting electrode. In the above antenna device, the first portion of the first antenna member is connected to the first tunnel diode, and the second portion of the first antenna member is connected to the fixed potential. When the first antenna member receives light to be received, the Fermi potential at the first portion of the first antenna member fluctuates up and down based on the alternation electric field of the light. The energized carriers based on the alternation electric field of the light can travel through the first tunnel diode. The above antenna device may produce an electric current of half-wave rectification with at least one tunnel diode.

The antenna device disclosed in this specification may produce an electric current of full-wave rectification. The antenna device of this type may further comprise a second connecting electrode, a second tunnel diode and a second antenna member. The second connecting electrode may be configured to be connected to the fixed potential via the load. The second tunnel diode may have a pair of electrodes. One of the electrodes of the second tunnel diode may be connected to the second connecting electrode. The other electrode of the second tunnel diode may be connected to the second antenna member. The second antenna member may have a conductive property and include a third portion and a forth portion. The third portion of the second antenna member may be connected to the fixed electrode. The forth portion of the second antenna member may be connected to the other electrode of the second tunnel diode. The first, second, third and forth portions may be arranged along a straight line, and a distance between the first and second portions may be equal to a distance between the third and forth portions. In one preferred embodiment, a cathode of the first tunnel diode may be connected to the first portion of the first antenna member, an anode of the first tunnel diode may be connected to the first connecting electrode, a cathode of the second tunnel diode may be connected to the forth portion of the second antenna member, and an anode of the second tunnel diode may be connected to the second connecting electrode. When the first and second antenna members receive the light to be received, the Fermi potential at the first portion of the first antenna member and the Fermi potential at the forth portion of the second antenna member alternately go up and down based on the alternation electric field of the light. Therefore, the phenomenon of hot carriers traveling through the first tunnel diode and the phenomenon of hot carriers traveling through the second tunnel diode alternately occur. The above antenna device may produce an electric current of full-wave rectification with at least two tunnel diodes.

According to an antenna device of one preferred embodiment, the first antenna member may extend along the straight line. The first antenna member may have a length equal to one-fourth (¼) of a wavelength of the light to be received by the first and second antenna members. The second antenna member also may extend along the straight line and have the same length. The first and second antenna members may be integrally formed to compose an integral antenna member. The integral antenna member may have a length equal to one-half (½) of the wavelength of the light to be received by the first and second antenna members. The above antenna device may effectively receive the light to be received by setting a longitudinal direction and a length of the integral antenna member based on a plane of vibration of an electric field and wavelength of the light to be received.

In a case where the light to be received includes different wave lengths, the above antenna device may comprise a plurality of antenna members and a plurality of pairs of tunnel diodes. In this case, each of distances between the first and forth portions of the plurality of integral antenna members may differ from each other. When the antenna device comprises a plurality of antenna members including different lengths, the antenna device may effectively transduce the light configured with different wavelengths to an electric current.

In a case where the light to be received includes different wave lengths, the above antenna device may comprise a plurality of antenna members and a plurality of pairs of tunnel diodes. In this case, a distance between a pair of integral antenna members fabricated next to each other may differ from a distance between another pair of integral antenna members fabricated next to each other. When the antenna device comprises an above-mentioned layout of the plurality of antenna members, it is possible to change the spatial resonance frequency for the plurality of antenna members. Therefore, the antenna device may effectively transduce the light configured with different wavelengths to an electric current.

In a case where the light to be received includes a plurality of light waves having different planes of vibrations of electric fields, the above antenna device may comprise the plurality of antenna members and the plurality of pairs of tunnel diodes. In this case, the plurality of antenna members may compose a plurality of integral antenna members, which may include a first group extending along a first direction and a second group extending along a second direction that is different from the first direction. When the antenna device comprises a plurality of antenna members including different longitudinal directions, the antenna device may effectively transduce the light configured with different planes of vibrations of electric fields to an electric current.

In the case where the first and second antenna members compose the integral antenna member, the integral antenna member may include a carbon material. More preferably, a kind of the carbon material may be a carbon nanotube. When the carbon material is adapted as a material of the integral antenna member, electrons can travel in the integral antenna member at high velocities, and a photoelectric conversion efficiency may be improved.

According to an antenna device of one preferred embodiment, the first and second antenna members may be integrally formed to form a plane antenna member. The second portion of the first antenna member and the third portion of the second antenna member may share a common portion within the plane antenna member. The first portion of the first antenna member and the forth portion of the second antenna member may be separately arranged such that the common portion is located between the first portion and the forth portion. Since the above antenna device forms the plane antenna member, the above antenna member has higher mechanical strength and higher reliability.

In the case where the light to be received include the plurality of lights having different planes of vibrations of electric field, the first and forth portions may preferably be arranged at corners in the plane antenna member, where the corners are diagonal corners. That is, the first tunnel diode connected to the first portion and the second tunnel diode connected to the forth portion may be arranged at corners in the plane antenna member, that are diagonal to each other. When the first and second tunnel diodes are arranged at the above positional relationship, the antenna device may effectively transduce the light configured with different planes of vibrations of electric field to an electric current.

In the case where the first and second antenna members compose the plane antenna member, the plane antenna member may include a carbon material. In more preferably, a kind of the carbon material may be a graphene. When the carbon material is adapted as a material of the plane antenna member, electrons can travel in the plane antenna member at high velocities, and a photoelectric conversion efficiency may be improved.

According to an antenna device of another preferred embodiment, the antenna device may further comprise a substrate having an insulating property. In this case, the first and second connecting electrodes and the fixed electrode may be fabricated on a surface of the substrate. The first tunnel diode may be fabricated on a surface of the first connecting electrode, and the second tunnel diode may be fabricated on a surface of the second connecting electrode. The above antenna device may be manufactured with low cost by mean of the technique of a semiconductor manufacturing process.

In the case where the antenna device comprises the substrate, each of the first and second connecting electrodes may be fabricated in a depressed area of the substrate. In this case, a distance between a surface of the depressed area on which the first connecting electrode is fabricated and the first antenna member, as well as a distance between a surface of the depressed are on which the second connecting electrode is fabricated and the second antenna member can be made large. As a result, an electric field at surfaces of the first and second connecting electrodes is suppressed from giving effect the first and second antenna members.

The distance between the surface of the depressed area on which the first connecting electrode is fabricated and the first antenna member may be equal to or greater than one-forth of the wavelength of the light to be received by the first and second antenna members. Also, the distance between the surface of the depressed area on which the second connecting electrode is fabricated and the second antenna member may be equal to or greater than one-forth of the aforesaid wavelength. In this case, a loop of a reflected light which is reflected at the first and the second connecting electrodes and an incident light overlap at the first and the second antenna members. Therefore, an electric field applied to the first and the second antenna members is thereby strengthened.

In the case where the antenna device comprises the substrate, the antenna device may comprise plural pairs of the first and second antenna members. In this case, at least one pair of the first and second antenna members may be fabricated on a first surface of the substrate. Further, at least another pair of the first and second antenna members may be fabricated on a second surface of the substrate, where the second surface is different from the first surface. Since each of the pairs of the first and second antenna members is fabricated on different surfaces of the substrate, the antenna device may effectively transduce the light configured with different planes of vibrations of electric field to an electric current.

In the case where pairs of the first and second antenna members are fabricated on different surfaces of the substrate, a material of the substrate may be transparent relative to the light. In this case, the light which has not been transduced at one pair of the first and second antenna members fabricated on the one surface of the substrate can travel through the substrate, and can be transduced at another pair of first and second antenna members fabricated on another one surface of the substrate. Therefore, a photoelectric conversion efficiency may be improved.

The antenna device disclosed in this specification may transmit and/or receive light, even though the configuration of the antenna device is simple. For the example, the antenna device disclosed in this specification may produce the electric current of half-wave rectification with at least one tunnel diode. Also, the antenna device disclosed in this specification may produce the electric current of full-wave rectification with at least two tunnel diodes.

First Embodiment

FIG. 1 shows the configuration of an antenna device 10 for half-wave rectification. The antenna device 10 is provided with an antenna element 20 that supplies current to a load 60. The antenna element 20 has an antenna member 30, a tunnel diode 40, a connecting electrode 52 and a fixed electrode 54.

Figure 2:
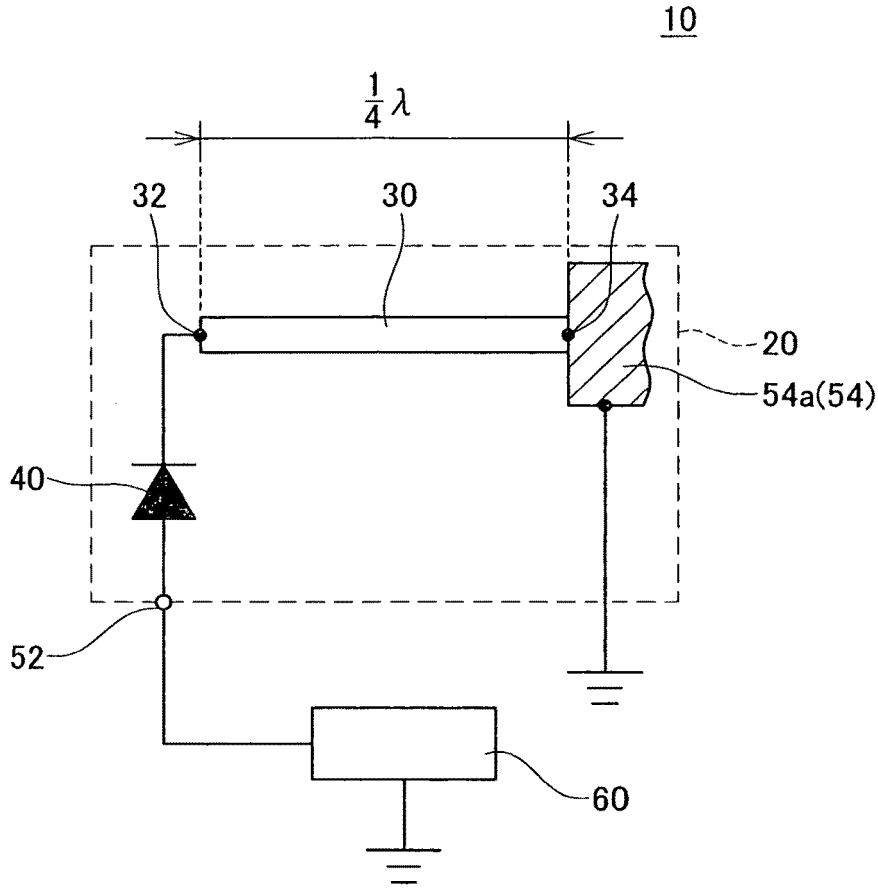
FIG. 2 shows a specific configuration of the antenna device of the first embodiment.

The antenna member 30 is electrically conductive and has a linear or flat shape. The antenna member 30 is provided with a portion having a length equal to ¼ of the wavelength λ of light to be received, and the aforesaid portion between one end 32 of that portion (an example of a first portion) and the other end 34 (an example of a second portion) extends along a straight line. The tunnel diode 40 is connected between the one end 32 of the antenna member 30 and the connecting electrode 52, and selectively allows transmission of hot electrons energized to a predetermined energy level. The cathode of the tunnel diode 40 is connected to the one end 32 of the antenna member 30, while the anode is connected to the connecting electrode 52. The fixed electrode 54 is connected to the other end 34 of the antenna member 30. The fixed electrode 54 is fixed to a ground potential. Furthermore, as shown in FIG. 2, the fixed electrode 54 preferably has a conductor portion 54*a* that contacts the other end 34 of the antenna member 30. The antenna member 30 preferably contacts the conductor portion 54*a* perpendicular thereto. The conductor portion 54*a* has adequate thickness and is able to provide a mirror image antenna of the antenna member 30. The load 60 is provided with a connecting terminal 62 and a fixed terminal 64, and together with the connecting terminal 62 being connected to the connecting electrode 52, the fixed terminal 64 is connected to the ground potential.

Figure 3:
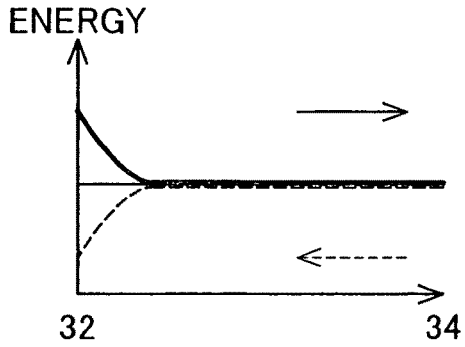
FIG. 3 indicates the Fermi potential within an antenna member of the antenna device of the first embodiment.

FIG. 3 indicates the Fermi potential within the antenna member 30 when light of a wavelength λ has been received by the antenna member 30. The horizontal axis of FIG. 3 represents the location of the antenna member 30 in a direction extending along the straight line, while the vertical axis represents the Fermi potential at the respective locations. When light of wavelength λ enters the antenna member 30, electrons periodically concentrate at the one end 32 of the antenna member 30 in synchronization with an alternating electric field. When an electric field oriented to the right as viewed in the drawing (indicated with the solid arrow in FIG. 3) is applied to the antenna member 30, the electrons concentrate in the one end 32 of the antenna member 30, and the Fermi potential at the one end 32 of the antenna member 30 rises. When an electric field oriented to the left as viewed in the drawings (indicated with the broken line arrow in FIG. 3) is applied to the antenna member 30, the Fermi potential of the one end 32 of the antenna member 30 drops. The Fermi potential of the one end 32 of the antenna member 30 repeatedly fluctuates up and down in synchronization with the alternating electric field.

When the Fermi potential of the one end 32 of the antenna member 30 rises due to application of the electric field oriented to the right as viewed in the drawing, the hot electrons travel through the tunnel diode 40 after having passed through a discrete energy level within the tunnel diode 40. Since the other end 34 of the antenna member 30 is connected to the ground potential, and the load 60 is also connected to the ground potential, a loop is formed between the antenna member 30 and the load 60 via the ground potential. Consequently, the electrons that have traveled through the tunnel diode 40 are able to flow into the load 60. The antenna device 10 is able to supply half-wave-rectified current to the load 60 using a single tunnel diode 40.

Second Embodiment

Figure 4:
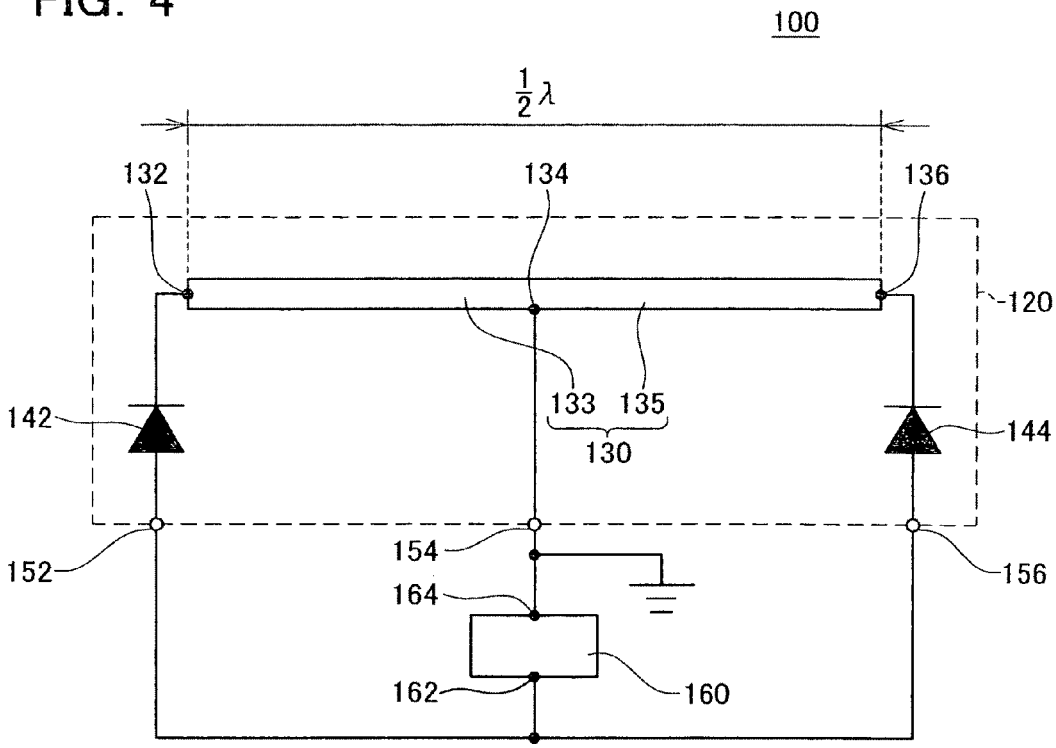
FIG. 4 shows a configuration of an antenna device of a second embodiment.

FIG. 4 shows the configuration of an antenna device 100 for full-wave rectification. The antenna device 100 is provided with an antenna element 120 that supplies current to a load 160. The antenna element 120 has an antenna member 130, a first tunnel diode 142, a second tunnel diode 144, a first connecting electrode 152, a second connecting electrode 156, and a fixed electrode 154.

The antenna member 130 is electrically conductive and has a linear or flat shape. The antenna member 130 is provided with a portion having a length equal to ½ of the wavelength λ, of light to be received, and the aforesaid portion between one end 132 of that portion and the other end 136 extends along a straight line. The portion of the antenna member 130 that extends along the straight line includes a first antenna member 133 and a second antenna member 135. The first antenna member 133 and the second antenna member 135 extend symmetrically with respect to a center portion 134 (and these are examples of the second portion and a third portion). The lengths of the first antenna member 133 and the second antenna member 135 in the direction extending along the straight line are each set to ¼ of the wavelength λ of the light. The first tunnel diode 142 is connected between the one end 132 of the antenna member 130 (another example of the first portion) and the first connecting electrode 152, and selectively allows the transmission of the hot electrons energized to a predetermined energy level. The cathode of the first tunnel diode 142 is connected to the one end 132 of the antenna member 130, while the anode is connected to the first connecting electrode 152. The second tunnel diode 144 is connected between the other end 136 of the antenna member 130 (example of a fourth portion) and the second connecting electrode 156, and selectively allows the transmission of the hot electrons energized to the predetermined energy level. The cathode of the second tunnel diode 144 is connected to the other end 136 of the antenna member 130, while the anode is connected to the second connecting electrode 156. The fixed electrode 154 is connected to the center portion 134 of the antenna member 130. The fixed electrode 154 is connected to a ground potential. The load 160 is provided with a connecting terminal 162 and a fixed terminal 164, the connecting terminal 162 is connected to the first connecting electrode 152 and the second connecting electrode 156 respectively, and the fixed electrode 164 is connected to the ground potential.

Figure 5:
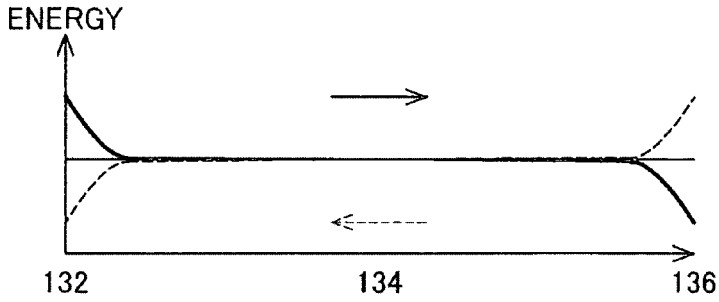
FIG. 5 indicates the Fermi potential within an antenna member of the antenna device of the second embodiment.

FIG. 5 indicates the Fermi potential within the antenna member 130 when light of a wavelength λ has been received by the antenna member 130. The horizontal axis of FIG. 5 represents the location of the antenna member 30 in a direction extending along the straight line, while the vertical axis represents the Fermi potential at the respective locations. When the light of the wavelength λ enters the antenna member 130, electrons alternately concentrate at the both ends 132 and 136 of the antenna member 130 in synchronization with the alternating electric field. When an electric field oriented to the right as viewed in the drawing (indicated with the solid arrow in FIG. 5) is applied to the antenna member 130, electrons concentrate at the one end 132 of the antenna member 130 and the Fermi potential of the one end 132 of the antenna member 130 rises. On the other hand, when an electric field oriented to the left as viewed in the drawing (indicated with a broken line arrow in FIG. 5) is applied to the antenna member 130, the electrons concentrate at the other end 136 of the antenna member 130 and the Fermi potential of the other end 136 of the antenna member 130 rises. Thus, the Fermi potentials of both ends of the antenna member 130 repeatedly fluctuate up and down in synchronization with the alternating electric field.

When the Fermi potential at the one end 132 of the antenna member 130 rises due to application of the electric field oriented to the right as viewed in the drawing, the hot electrons that have passed through a discrete energy level within the first tunnel diode 142 travel through the first tunnel diode 142. Since the center portion 134 of the antenna member 130 is connected to the ground potential and the load 160 is also connected to the ground potential, a loop is formed between the antenna member 130 and the load 160 via the ground potential. Consequently, the electrons that have traveled through the first tunnel diode 142 are able to flow into the load 160. In addition, when the Fermi potential at the other end 136 of the antenna member 130 rises due to application of the electric field oriented to the left as viewed in the drawing, the hot electrons that have passed through a discrete energy level within the second tunnel diode 144 travel through the second tunnel diode 144. Since the center portion 134 of the antenna member 130 is connected to the ground potential and the load 160 is also connected to the ground potential, a loop is formed between the antenna member 130 and the load 160 via the ground potential. Consequently, the electrons that have traveled through the second tunnel diode 144 are able to flow into the load 160. As a result, in the antenna device 100, current is supplied to the load 160 via the first tunnel diode 142 when the electric field oriented to the right as viewed in the drawing is applied to the antenna member 130, and current is supplied to the load 160 via the second tunnel diode 144 when the electric field oriented to the left as viewed in the drawing is applied to the antenna member 130. Thus, the antenna device 100 is able to supply current to the load 160 regardless of whether the alternating electric field is oriented to the left or right as viewed in the drawing. The antenna device 100 is able to provide full-wave-rectified current to the load 160 by using the two tunnel diodes 142 and 144.

Figure 6:
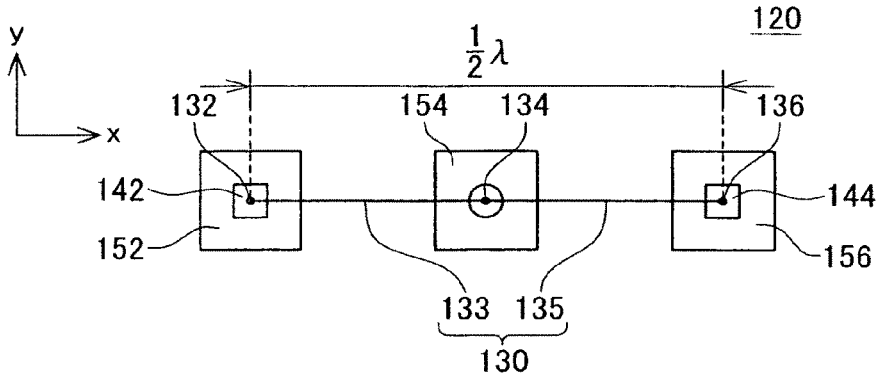
FIG. 6 shows an example of an overhead view of the antenna device of the second embodiment.

FIG. 6 shows an example of the antenna element 120 of the antenna device 100 shown in FIG. 4. FIG. 6 is a schematic diagram of an overhead view of the antenna element 120. This antenna element 120 is characterized by the antenna member 130 having a linear shape. This antenna member 130 is able to selectively receive the light of wavelength λ as a result of the plane of vibration of the electric field of the light to be received being parallel to the x axis.

Figure 7:
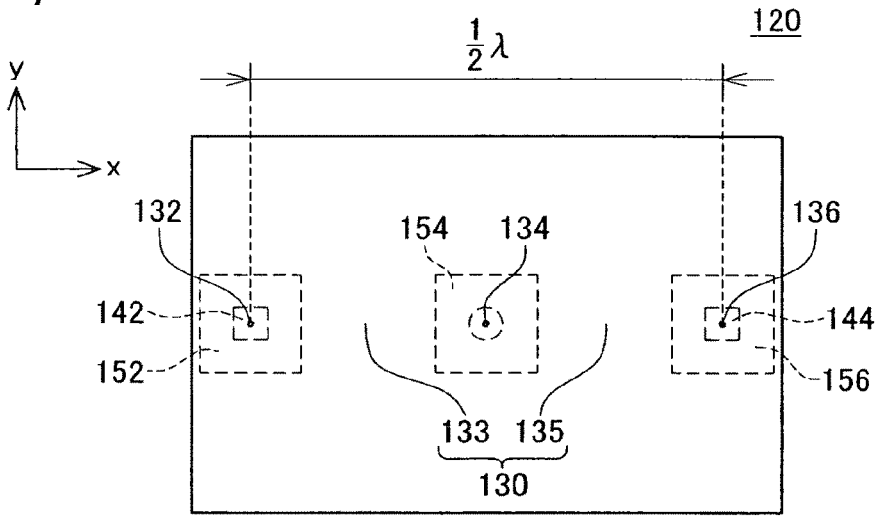
FIG. 7 shows another example of the overhead view of the antenna device of the second embodiment.

FIG. 7 shows another example of the antenna element 120 of the antenna device 100 shown in FIG. 4. FIG. 7 is a schematic diagram of another overhead view of the antenna element 120. This antenna element 120 is characterized by the antenna member 130 having the shape of a flat plate. This antenna member 130 is able to receive the light of wavelength λ as a result of the plane of vibration of the electric field of the light to be received being parallel to the x axis. In addition, this flat antenna member 130 is also able to receive light in which the plane of vibration of the electric field is slightly inclined relative to the x axis. Consequently, the flat antenna member 130 is able to have a wider allowable range with respect to the plane of vibration of the electric field of the light to be received. Furthermore, the antenna member 130 of this example has a rectangular shape when viewed from overhead. The antenna member 130 may also have a polyhedral shape, oval shape or circular shape instead of the shape shown in this example.

Figure 8:
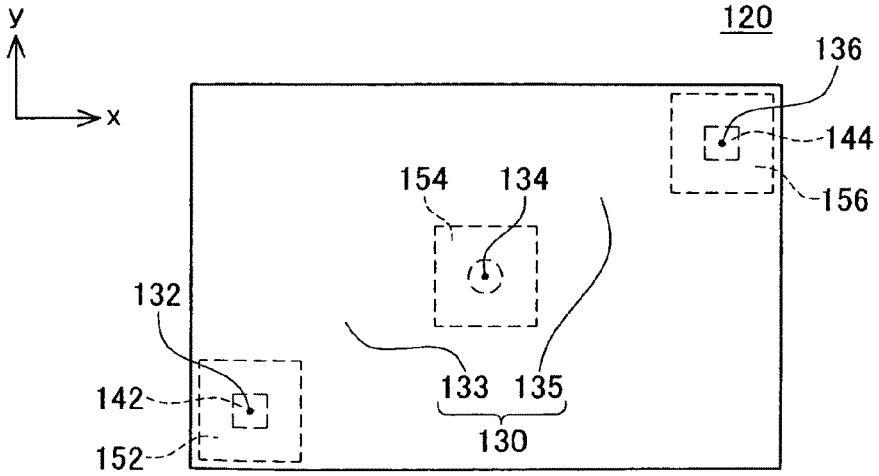
FIG. 8 shows another example of the overhead view of the antenna device of the second embodiment.

FIG. 8 shows yet another example of the antenna element 120 of the antenna device 100 shown in FIG. 4. FIG. 8 is a schematic drawing of yet another overhead view of the antenna element 120. This antenna element 120 is characterized by the antenna member 130 having the shape of the flat plate. Moreover, this antenna element 120 is characterized by the first tunnel diode 142 and the second tunnel diode 144 being arranged in the corners of the antenna member 130 on a diagonal line. This antenna member 130 is also able to receive the light to be received in the form of circularly-polarized waves.

Example 1

The following provides a detailed explanation of an antenna device that embodies the technology disclosed in the present specification. Furthermore, the antenna device explained below is used to receive light having a wavelength shorter than that of infrared light, and more specifically, is used to receive light of a wavelength of 2 μm or less. More preferably, the antenna device explained below is used to receive light within the range of infrared light to visible light, and more specifically, is used to receive light of a wavelength within the range of 0.2 to 2 μm. The antenna device explained below can be applied to technologies for wireless transmission and/or reception of electrical power and technologies for generating electrical power from sunlight.

FIGS. 9A and 9B show the configuration of an antenna element 220 provided in an antenna device of the first example. The antenna element 220 is a basic unit of the antenna device. FIG. 9A schematically shows a longitudinal cross-sectional view of the antenna element 220. FIG. 9B schematically shows an overhead view of the antenna element 220. Furthermore, FIG. 9A is a longitudinal cross-sectional view taken along line A-A in FIG. 9B.

As shown in FIGS. 9A and 9B, the antenna element 220 is provided with an insulating substrate 260, a first connecting electrode 252 provided on the surface of the substrate 260, a fixed electrode 254 provided on the surface of the substrate 260, a second connecting electrode 256 provided on the surface of the substrate 260, a first tunnel diode 242 provided on the surface of the first connecting electrode 252, a second tunnel diode 244 provided on the surface of the second connecting electrode 256, and a linear antenna member 230.

A material having high heat resistance able to withstand heat treatment applied in a production process is preferably used for the material of the substrate 260. Examples of substrates that can be used for the substrate 260 include glass substrates having a high phase transition temperature, quartz substrates, alumina substrates and ceramic substrates. In addition, a substrate in which an insulating material is coated on the surface of a metal substrate or semiconductor substrate may also be used for the substrate 260. In this case, a material such as silicon or gallium arsenide can be used for the material of the semiconductor substrate.

The first connecting electrode 252 is provided in a groove formed in a surface layer of the substrate 260. A material such as aluminum, nickel, titanium, gold or silver can be used for the material of the first connecting electrode 252. A distance G1 between the first connecting electrode 252 and the linear antenna member 230 is preferably equal to ¼ or more of the wavelength λ of the light to be received. A horizontal electric field becomes zero in the vicinity of the surface of the flat first connecting electrode 252. Consequently, the linear antenna member 230 is preferably provided on the first connecting electrode 252 and has the distance G1 equal to ¼ or more of the wavelength λ of the light to be received. More preferably, the distance G1 is ¼ of the wavelength λ of the light to be received. A loop of incident light and reflected light reflected at the first connecting electrode 252 overlaps with the linear antenna member 230, and an electric field applied to the linear antenna member 230 becomes stronger. Furthermore, a load not shown is connected to the first connecting electrode 252.

The fixed electrode 254 is provided on the surface of the substrate 260, and has a first fixed electrode 254*a* and a second fixed electrode 254*b*. The first fixed electrode 254*a* is provided on a portion of the surface of the second fixed electrode 254*b*, and is used to improve adhesion to the linear antenna member 230. The material of the first fixed electrode 254*a* is preferably a material that is able to be alloyed with the material of the linear antenna member 230. For example, in the case where the material of the linear antenna member 230 is a nanocarbon material such as a carbon nanotube, the material of the first fixed electrode 254*a* is preferably a metal material capable of forming carbide at the growth temperature of the nanocarbon material. More specifically, a material such as aluminum, nickel or titanium can be used for the material of the first fixed electrode 254*a*. The second fixed electrode 254*b* is used to improve adhesion of the substrate 260 with the first fixed electrode 254*a*. A metal material typically known to be an electrode material is preferably used for the material of the second fixed electrode 254*b*, and examples of materials used include aluminum, nickel, titanium, gold, silver and copper. The fixed electrode 254 is fixed to a ground potential.

The second connecting electrode 256 is provided in a groove formed in the surface of the substrate 260. A material such as aluminum, nickel, titanium, gold or silver can be used for the material of the second connecting electrode 256. A distance G2 between the second connecting electrode 256 and the linear antenna member 230 is also preferably equal to ¼ or more of the wavelength λ of the light to be received. More preferably, the distance G2 is equal to ¼ of the wavelength λ of the light to be received. Furthermore, the load not shown is also connected to the second connecting electrode 256.

The first tunnel diode 242 and the second tunnel diode 244 have an identical structure. Metal-insulator-metal (MIM) diodes, metal-insulator-insulator-metal (MUM) diodes or resonant tunnel diodes are preferably used for the first tunnel diode 242 and the second tunnel diode 244. The following provides an explanation of the structures of the first tunnel diode 242 and the second tunnel diode 244 with reference to FIGS. 10 to 14. Furthermore, although the explanations provided with reference to FIGS. 10 to 14 use the example of the first tunnel diode 242, the same structure is applied to the second tunnel diode 244 as well.

Figure 10:
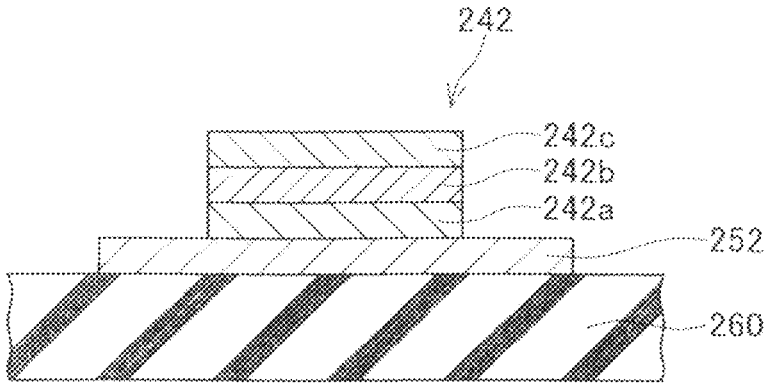
FIG. 10 shows an example of a cross-sectional view in a case of applying an MIM tunnel diode for a first tunnel diode.

FIG. 10 shows an example of the first tunnel diode 242 in the form of an MIM tunnel diode. The first tunnel diode 242 has a first metal thin film 242*a* (which is an example of "the other electrode" in claims, and is an anode in this example), a second metal thin film 242*c* (which is an example of "one electrode" in claims, and is a cathode in this example), and an insulating thin film 242*b* provided between the first metal thin film 242*a* and the second metal thin film 242*c*.

Figure 11:
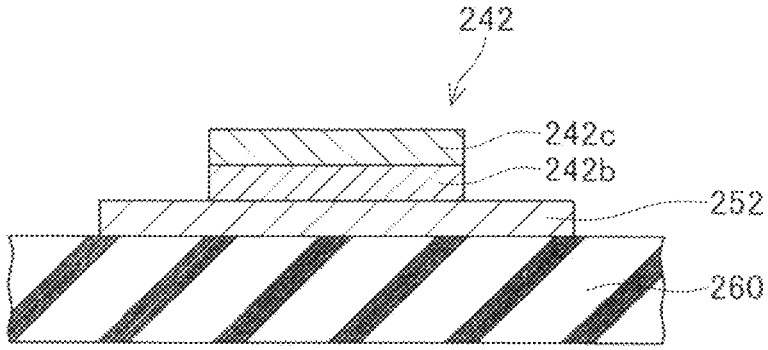
FIG. 11 shows another example of a cross-sectional view in the case of applying the MIM tunnel diode for the first tunnel diode.

A material such as aluminum, platinum, nickel, palladium, gold, molybdenum, chromium or silver is used for the material of the first metal thin film 242*a*. Furthermore, as shown in FIG. 11, the first metal thin film 242*a* of the first tunnel diode 242 may be omitted. In this case, the first connecting electrode 252 fulfills the role of the first metal thin film 242*a*.

A metal oxide film such as a nickel oxide film, chromium oxide film, niobium oxide film or aluminum oxide film can be used for the material of the insulating thin film 242*b*. The thickness of the insulating thin film 242*b* is the thickness at which electrons can be transmitted by tunnel effects, and more specifically, is preferably within the range 0.5 to 10 nm. A native oxide film of the first metal thin film 242*a* can be used for the insulating thin film 242*b*. In addition, the insulating thin film 242*b* can also be formed by oxidizing the surface of the first metal thin film 242*a* in oxygen plasma. Alternatively, the insulating thin film 242*b* can be formed by heat-treating the surface of the first metal thin film 242*a* in an atmosphere containing oxygen. In addition, the insulating thin film 242*b* can also be formed by using a technology such as sputtering, which uses the metal oxide listed among the above-mentioned examples as a target, or vapor deposition, which uses the metal oxide listed among the above-mentioned examples as an evaporation source.

The second metal thin film 242*c* is preferably a catalyst metal that allows growth by the nanocarbon material serving as the material of the linear antenna member 230. More specifically, a material such as cobalt, nickel or alloy film thereof can be used for the material of the second metal thin film 242*c*. In addition, a metal film made of chromium, gold or titanium, for example, may be formed between the second metal thin film 242*c* and the insulating thin film 242*b* to improve adhesive properties as necessary.

Figure 12:
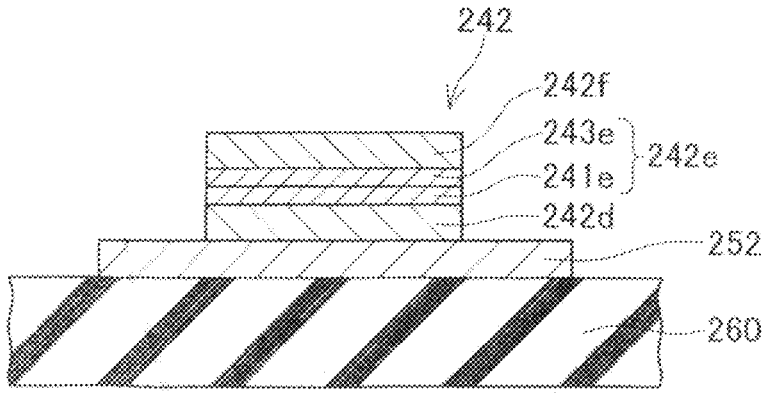
FIG. 12 shows an example of a cross-sectional view in the case of applying the MIIM tunnel diode for the first tunnel diode.

Next, FIG. 12 shows an example of using an MIIM tunnel diode for the first tunnel diode 242. The first tunnel diode 242 has a first metal thin film 242*d* (which is another example of "the other electrode", and is an anode in this example), a second metal thin film 242*f* (which is another example of "one electrode", and is a cathode in this example), and an insulating thin film 242*e* provided between the first metal thin film 242*d* and the second metal thin film 242*f*.

Figure 13:
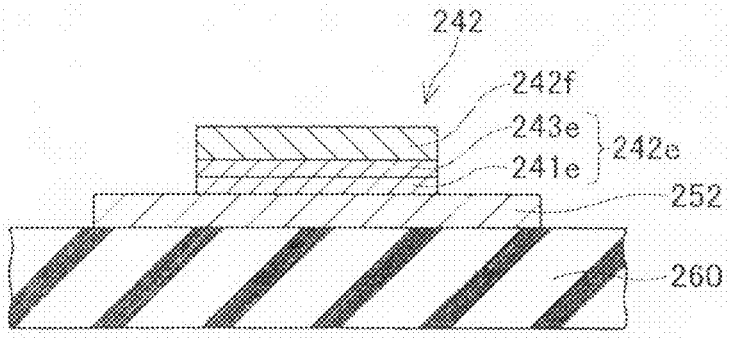
FIG. 13 shows another example of a cross-sectional view in the case of applying the MIM tunnel diode for the first tunnel diode.

A material such as aluminum, platinum, nickel, palladium, gold, molybdenum, chromium or silver is used for the material of the first metal thin film 242*d*. Furthermore, as shown in FIG. 13, the first metal thin film 242*d* of the first tunnel diode 242 may be omitted. In this case, the first connecting electrode 252 serves as the first metal thin film 242*d*.

The insulating thin film 242*e* has a bilayer structure consisting of a lower insulating thin film 241*e* and an upper insulating thin film 243*e*. Here, the difference between the work function of the first metal thin film 242*d* and the electron affinity of the lower insulating thin film 241*e* is greater than the difference between the work function of the second metal thin film 242*f* and the electron affinity of the upper insulating thin film 243*e*. As a result, when viewing the lower insulating thin film 241*e* from the upper insulating thin film 243*e*, the lower insulating thin film 241*e* forms an energy barrier against electrons. More specifically, chromium (Cr) is preferably used for the material of the first metal thin film 242*d* and the second metal thin film 242*f*, aluminum oxide ($Al_2O_3$) is preferably used for the material of the lower insulating thin film 241*e*, and chromium oxide ($Cr_2O_3$) is preferably used for the material of the upper insulating thin film 243*e*. In this example, the electron affinity of aluminum oxide is 1.78 eV, the work function of chromium is 4.5 eV, and the electron affinity of chromium oxide is 3.76 eV. Thus, the difference between the work function of the first metal thin film 242*d* and the electron affinity of the lower insulating thin film 241*e* is 2.72 eV, and the difference between the work function of the second metal thin film 242*f* and the electron affinity of the upper insulating thin film 243*e* is 0.74 eV. Consequently, when viewing the lower insulating thin film 241*e* from the upper insulating thin film 243*e*, the lower insulating thin film 241*e* forms an energy barrier against electrons having a height of 1.98 eV.

The lower insulating thin film 241*e* can use a native oxide film, plasma oxide film or thermal oxide film of the first metal thin film 242*d*. In addition, the lower insulating thin film 241*e* can also be formed by a technology such as sputtering or vacuum deposition. The upper insulating thin film 243*e* can be formed using a technology such as sputtering or vacuum deposition. The thickness of the upper insulating thin film 243*e* is the thickness at which the electrons are able to be transmitted by the tunnel effects from the second metal thin film 242*f* towards a potential dip formed at the interface of the lower insulating thin film 241*e* and the upper insulating thin film 243*e*; and, more specifically, is preferably within the range of 0.5 to 10 nm. The thickness of the lower insulating thin film 241*e* is the thickness at which the electrons are able to be transmitted by the tunnel effects towards the first metal thin film 242*d* from the potential dip formed at the interface of the lower insulating thin film 241*e* and the upper insulating thin film 243*e*; and, more specifically, is preferably within the range of 0.5 to 10 nm.

Figure 14:
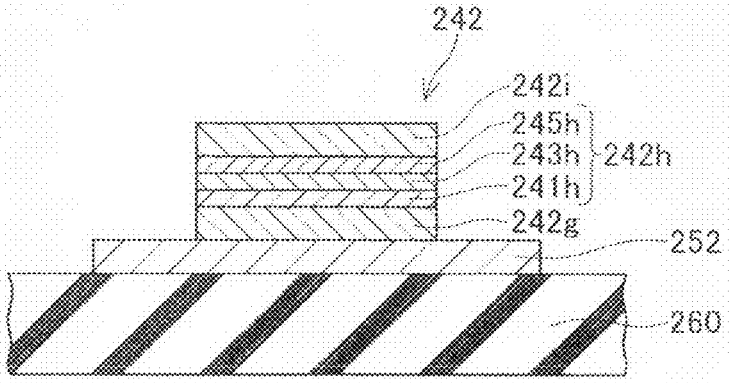
FIG. 14 shows an example of a cross-sectional view in a case of applying a resonant tunnel diode for the first tunnel diode.

Next, FIG. 14 shows an example of using a resonant tunnel diode for the first tunnel diode 242. The first tunnel diode 242 has a first metal thin film 242*g* (which is another example of "the other electrode"), a second metal thin film 242*i* (which is another example of "one electrode"), and an intermediate film 242*h* provided between the first metal thin film 242*g* and the second metal thin film 242*i*.

A metal material typically known to be an electrode material is preferably used for the material of the first metal film, and examples of materials used include aluminum, nickel, titanium, gold, silver and copper.

The intermediate film 242*h* has a first energy barrier film 241*h*, a semiconductor film 243*h* and a second energy barrier film 245*h*. The first energy barrier film 241*h* and the second energy barrier film 245*h* are formed with an insulator or semiconductor. The energy level of the conduction band minimum of the material of the first energy barrier film 241*h* and the second energy barrier film 245*h* is higher than the energy level of the conduction band minimum of the material of the semiconductor film 243*h*. In addition, the thickness of the first energy barrier film 241*h* and the second energy barrier film 245*h* is the thickness at which the electrons are able to be transmitted by tunnel effects, and more specifically, is preferably within the range of 0.5 to 10 nm. An insulator such as silicon dioxide, alumina, silicon carbide or calcium fluoride, or a semiconductor such as aluminum arsenide, silicon carbide or germanium nitride, is preferably used for the material of the first energy barrier film 241*h* and the second energy barrier film 245*h*.

The forbidden bandwidth of the material of the semiconductor film 243*h* is narrower than the forbidden bandwidth of the material of the first energy barrier film 241*h* and the second energy barrier film 245*h*. A material such as silicon, silicon-germanium, gallium arsenide or gallium indium arsenide is preferably used for the material of the semiconductor film 243*h*. In addition, the thickness of the semiconductor film 243*h* is the thickness at which a discrete electron energy level is formed, and more specifically, is preferably within the range 0.5 to 10 nm. A spacer film may be formed between the semiconductor film 243*h* and the first energy barrier film 241*h* and between the semiconductor film 243*h* and the second energy barrier film 245*h*. The spacer film can be formed with same semiconductor material as the material of the semiconductor film 243*h*. In addition, the spacer film can also be formed with a semiconductor material having enhanced electrical conductivity by introducing impurities into the same semiconductor material as that of the semiconductor film 243*h*. More specifically, the thickness of the spacer film is preferably within the range of 0.01 to 0.3 μm.

The second metal thin film 242*i* is preferably a catalyst metal that is required for growth of the nanocarbon material serving as the material of the linear antenna member 230. A material such as cobalt, nickel or alloy film thereof can be used for the material of the second metal thin film 242*i*.

The resonant tunnel diode is particularly preferable among the above-mentioned examples of the tunnel diodes. In general, the impedance of the antenna member 230 to high-frequency electromagnetic waves is about 50Ω. The impedance of the antenna member 230 is about 50Ω even if the length of the antenna member 230 is small corresponding to the wavelength of light to be received. Consequently, it is effective to reduce the parasitic capacitance of the tunnel diodes 242 and 244 to increase the response time of the antenna device.

The resonant tunnel diodes are known to have the parasitic capacitance per unit area of $1.5\times10^{-7}$ F/cm$^2$ or less. Consequently, even if assuming an impedance of the linear antenna member 230 of 50Ω, a response can be made to light of a frequency of 1000 THz (wavelength: 0.3 μm) with a resonant tunnel diode having a diameter of 52 nm. If the diameter of 52 nm is required, the resonant tunnel diodes can be formed using known microprocessing technologies such as electron beam lithography. In addition, the resonant tunnel diodes have a single quantum well surrounded by two energy barrier films. Consequently, electrons that have entered the resonant tunnel diode are able to travel through the two energy barrier films at a probability of 1 if the energy thereof coincides with one energy level within the quantum well. Consequently, resonant tunnel diodes are theoretically not susceptible to the occurrence of attenuation of signal strength during electron transmission. An antenna device that uses the resonant tunnel diode is able to convert light energy to electrical energy with high efficiency.

Returning to FIG. 9, the linear antenna 230 has a linear shape and extends farther in one direction (the direction of x axis). The length of the linear antenna member 230 in the lengthwise direction (the direction of x axis) is set to ½ of the wavelength λ of light to be received. The linear antenna member 230 has a first antenna member 233 and a second antenna member 235. The first antenna member 233 and the second antenna member 235 extend symmetrically with respect to a center portion 234 of the antenna member 230 (examples of the second portion and the third portion). The lengths of the first antenna member 233 and the second antenna member 235 in the lengthwise direction are each set to ¼ of the wavelength λ of light to be received.

One end 232 of the first antenna member 233 (which is another example of the first portion) contacts the first tunnel diode 242, while the other end 234 of the first antenna member 233 (which is another example of the second portion) contacts the fixed electrode 254. One end 234 of the second antenna member 235 (which is another example of the third portion) contacts the fixed electrode 254, while the other end 236 of the second antenna member 235 (which is another example of the fourth portion) contacts the second tunnel diode 244. The first antenna member 233 and the second antenna member 235 are in contact on the fixed electrode 254, and the other end 234 of the first antenna member 233 and the one end 234 of the second antenna member 235 constitute a common portion.

A material such as a carbon nanotube is preferably used for the material of the linear antenna member 230. As was previously described, a catalyst metal required to grow the carbon nanotube is used for the second metal thin film on the surfaces of the first tunnel diode 242 and the second tunnel diode 244. Consequently, if a technology such as chemical vapor deposition or arc discharge is used, a carbon nanotube can be grown by using the second metal thin film as a growth catalyst. On the other hand, the fixed electrode 254 is formed with a metal material that enables carbide to be grown at the growth temperature of the carbon nanotube. Consequently, if the carbon nanotube is grown from the second metal thin film on the surfaces of the first tunnel diode 242 and the second tunnel diode 244, and the tip of the carbon nanotube reaches the surface of the fixed electrode 254, the carbon that composes the carbon nanotube forms an alloy by contacting the fixed electrode 254. As a result, the linear antenna member 230 and the fixed electrode 254 are both connected electrically and strongly bonded.

In order for the electrons in the linear antenna member 230 to be alternately energized at both ends 232 and 236 of the linear antenna member 230 in synchronization with an alternating electric field of light, the electrons preferably concentrate at both ends 232 and 236 of the linear antenna member 230 and the electron densities at both ends 232 and 236 preferably increase. The electron densities at both ends 232 and 236 are proportional to electron drift velocity and application time of the alternating electric field. The application time of the alternating electric field is uniquely determined according to the wavelength λ of light to be received. Thus, in order to enhance the electron densities at both ends 232 and 236, it is preferable to improve the electron drift velocity and cause the electrons present in the linear antenna member 230 to alternately move to the both ends 232 and 236. In order to accomplish this, the electron drift velocity is preferably fast enough so that the electrons within the linear antenna member 230 are able to move from one end to the other. For example, in order to receive light of a wavelength of 0.2 to 2 μm, the length of the linear antenna member 230 in the lengthwise direction is set to within the range of 0.1 to 1 μm. The electron drift velocity is preferably $10^8$ m/s or more in order to allow the electrons to move within the linear antenna member 230 of this length from one end to the other in synchronization with an alternating electric field. As an example thereof, a case is considered in which the antenna device of the present example is used to receive electromagnetic waves having an intensity roughly equal to that of sunlight. The solar constant (amount of energy carried by sunlight to a surface area of 1 $m^2$ of the earth's surface in 1 second) is about $10^3$ W/$m^2$. On the other hand, when the electric field of the electromagnetic waves is defined as E and the dielectric constant of the medium that transmits the electromagnetic waves is defined as ∈, then the amount of energy carried by the electromagnetic waves to 1 $m^2$ of the earth's surface in 1 second becomes $\in E^2$ (MKSA unit system). When considering the propagation of electromagnetic waves in a vacuum, the electric field strength of electromagnetic waves of $10^3$/$m^2$ is calculated to be $10^7$ V/m. Since electron mobility is represented by (electron drift velocity)/(electric field strength), the electron mobility of the material of the linear antenna member 230 required to follow the alternating electric field of the electromagnetic waves is preferably about 10 $m^2$/Vs=100,000 $cm^2$/Vs or more. A nanocarbon material is preferably used for the material of the linear antenna member 230 in order to satisfy this condition, while the use of a carbon nanotube is more preferable.

Next, an explanation is provided of the operation of the antenna element 220. When the light in which the plane of vibration of the electric field is parallel to the longitudinal direction (direction of the x axis) of the linear antenna member 230 enters the linear antenna member 230, the electrons alternately concentrate at the both ends 232 and 236 of the antenna member 230 in synchronization with the alternating electric field. When the electric field oriented to the right as viewed in the drawing enters the linear antenna member 230, the electrons within the linear antenna member 230 concentrate at the left end 232 of the linear antenna member 230 due to the electric field. In addition, the light is of ultra-high-frequency electromagnetic waves. Consequently, the light is only able to penetrate the pole surfaces of the linear antenna member 230 due to the metal-like properties thereof, and is unable to penetrate inside the linear antenna member 230. Thus, bias in the electron distribution within the linear antenna member 230 only occurs at the surfaces of the linear antenna member 230. As a result, the electron density becomes extremely high at the left end 232 of the linear antenna member 230. At this time, since the electrons are forced to enter an energized energy level according to Coulomb repulsion and the Pauli exclusion principle, the Fermi potential at the left end 232 of the linear antenna member 230 rises. On the other hand, the Fermi potential at the right end 236 of the linear antenna member 230 falls. Next, when the electric field oriented to the left as viewed in the drawing enters the linear antenna member 230, the electrons concentrate at the right end 236 of the linear antenna member 230, and the Fermi potential at the right end 236 of the linear antenna member 230 rises. On the other hand, the Fermi potential at the left end 232 of the linear antenna member 230 falls. In this manner, when the light enters the antenna member 230, although the Fermi potentials at both ends 232 and 236 of the linear antenna member 230 fluctuate, the Fermi potential at the center portion 234 of the linear antenna member 230 remains stable. Fluctuations in the Fermi potential of the linear antenna member 230 occur point-symmetrically with respect to the center portion 234 of the linear antenna member 230. Thus, even if the center portion 234 of the linear antenna member 230 is grounded, the Fermi potentials of both ends 232 and 236 of the linear antenna member 230 alternately increase and decrease corresponding to periodical fluctuations in the electric field vector of the light.

When the electric field of the light is oriented to the right as viewed in the drawing, electrons are energized at the left end 232 of the linear antenna member 230 as previously described. The Fermi potential of the electrons at the left end 232 of the linear antenna member 230 at this time is at an energy level that is higher by an amount of $\Delta E_F$ than the Fermi potential $E_F$ of the linear antenna element 230 when not irradiated with light. When the phase angle of light radiated onto the linear antenna member 230 is defined as $\phi$ and the intensity E of the electric field of the light is represented as a sine function of $\phi$, then $\Delta E_F$ at the left end 232 of the linear antenna member 230 can be represented by the following equation (1). In addition, the following equation (2) is valid when the electron drift velocity is defined as $\mu$, ¼ the period of the light is defined as $\Delta t$, the electron density is defined as Ne, and the state density occupying the energy level E is defined as N(E).

$$\Delta E_F = \Delta E_{FMAX} \times \sin\phi \quad (1)$$

$$\text{No. of electrons converging at end} = \mu E \Delta t Ne = \int_0^{\Delta EFMAX} N(E)dE \quad (2)$$

When the electric field is oriented to the right as viewed in the drawing, the energy of electrons at the left end 232 of the linear antenna member 230 is at a higher level than the Fermi potential when the electric field is not applied. Consequently, the energized hot electrons travel through the first tunnel diode 242 due to the tunnel effects and are extracted into the first connecting electrode 252. At this time, in the case where the second tunnel diode 244 is the MIM tunnel diode, since the Fermi potential at the right end 236 of the linear antenna member 230 is at a low level, there are electrons that flow back from the second connecting electrode 256 to the linear antenna member 230 through the second tunnel diode 244 due to the tunnel effects. However, due to the non-linearity of the current-voltage characteristics of the second tunnel diode 244, the number of these electrons is less than the number of electrons extracted into the first connecting electrode 252 through the first tunnel diode 242. Thus, the electrons are able to flow into the load from the first connecting electrode 252. Similarly, in the case where the electric field is oriented to the left as viewed in the drawing, the electrons extracted into the second connecting electrode 256 are able to flow into the load. Thus, the antenna element 220 is able to supply full-wave-rectified current to the load.

As was previously described, in the case where the tunnel diodes 242 and 244 are the MIM diodes, the reverse flow of current is present. In order to make improvement on this point, the MIIM diodes or the resonant tunnel diodes are preferably used for the tunnel diodes 242 and 244 in which the electrons are transmitted by the tunnel effects via a discrete energy level formed in the quantum well surrounded by two energy barriers. The following provides an explanation of the case of using the resonant tunnel diode shown in FIG. 14 for the tunnel diodes 242 and 244.

In the resonant tunnel diode used for the tunnel diodes 242 and 244, one $E_{ESC}$ of a discrete energy level satisfies the following equation (3).

$$E_F + \Delta E_{FMAX} > E_{ESC} > E_F \quad (3)$$

Figure 15:
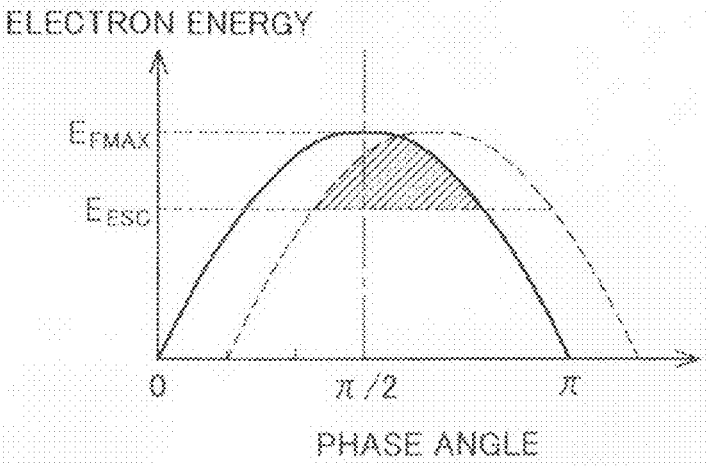
FIG. 15 shows a state of electrons used as an output.

Energy vibrations of the electrons that travel through the first tunnel diode 242 and reach the interface between the first tunnel diode 242 and the first connecting electrode 252 retard in phase in comparison with energy vibrations of the electrons at the left end 232 of the linear antenna member 230. The amount of time required for the electrons to travel through the first energy barrier film 241*h* and the second energy barrier film 245*h* of the first tunnel diode 242 is about $10^{-15}$ seconds, which is a value close to the period of visible light. This is illustrated in FIG. 15. The solid line in FIG. 15 indicates the Fermi potential at the left end 232 of the linear antenna member 230. The broken line in FIG. 15 indicates the Fermi potential at the interface between the first tunnel diode 242 and the first connecting electrode 252. The first tunnel diode 242 selectively allows the transmission of the electrons having the electron energy of $E_{ESC}$. Thus, the electrons are able to travel through the first tunnel diode 242 at the point the phase angle increases from 0° and the $E_F$ at the left end 232 of the linear antenna member 230 has reached $E_{ESC}$. However, as was previously described, due to the phase delay required for the electrons to travel through the first tunnel diode 242, output does not change until the energy of the electrons that have traveled through the first tunnel diode 242 reaches $E_{ESC}$. Moreover, when the phase angle increases, $E_F$ at the left end 232 of the linear antenna member 230 increases beyond $E_{ESC}$. Since the linear antenna member 230 is composed of a material having metallic properties, an energy level equal to or less than the Fermi potential is satisfied. Thus, in the case $E_F$ exceeds $E_{ESC}$, the electrons having $E_{ESC}$ energy are always present, and these electrons travel through the first tunnel diode 242. As a result, although levels at which the energy is $E_{ESC}$ become holes, there is no interruption in the flow of the electrons capable of passing through the first tunnel diode 242 since the electrons residing above the aforesaid levels with holes immediately occupy the holes. Moreover, as the phase advances and the energy of electrons at the left end 232 of the linear antenna member 230 becomes less than $E_{ESC}$, there are no longer any electrons able to travel through the first tunnel electrode 242, which consequently brings the output to drop to zero. Thus, the electrons corresponding to the hatched portion of FIG. 15 contribute in the form of current. On the other hand, the output voltage of the antenna element 220 is represented by the following equation (4). Here, e indicates the elementary electric charge.

$$(E_{ESC} - E_F)/e \quad (4)$$

Although the range of $E_{ESC}$ is effective provided it is within the range of the above-mentioned equation (3), it more preferably satisfies the following equation (5).

$$E_F + 0.9 \times \Delta E_F > E_{ESC} > E_F + 0.4 \times \Delta E_F \quad (5)$$

As shown in FIG. 15, since the number of the electrons that can be extracted decreases considerably when $E_{ESC}$ is greater than $E_F + 0.9 \times \Delta E_F$, the electrical energy that can be extracted by the antenna element 220 decreases. In addition, since $E_{ESC} - E_F$ becomes excessively small when $E_{ESC} < E_F + 0.4 \times \Delta E_F$, the output voltage of the antenna element 220 becomes small. Namely, the electrical power that can be extracted by the antenna element 220 decreases in this case as well.

As has been described above, the resonant tunnel diodes selectively allow transmission of only the electrons having energy equal to the discrete energy level formed in the quantum well. Thus, when the electric field oriented to the right as viewed in the drawing is applied to the antenna member 230, although the energized electrons travel through the first tunnel diode 242, there is no flow of the reverse current since there are no electrons present in the second tunnel diode 244 that have energy equal to the discrete energy level formed in the quantum well. The use of the resonant tunnel diodes for the tunnel diodes 242 and 244 dramatically improves loss during the conversion of light energy to electrical energy.

Figure 9:
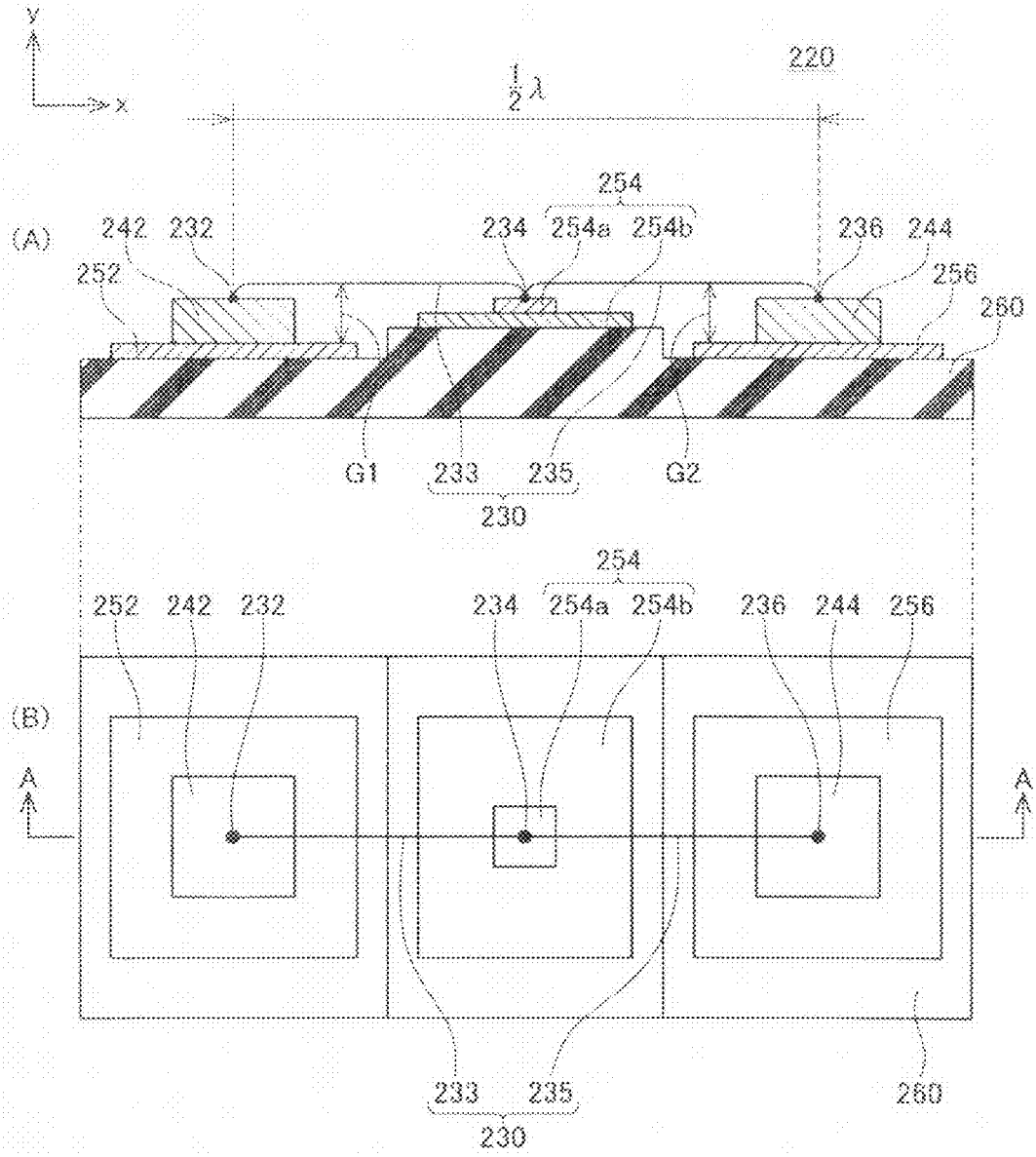
FIG. 9A schematically shows a cross-sectional drawing of an antenna element of a first example, while FIG. 9B schematically shows an overhead view of the antenna element of the first example.

The following provides an explanation of an example of an antenna device composed of a plurality of the antenna element 220 shown in FIG. 9. For example, in the case of applying the antenna device disclosed in the present specification to technology for generating electrical power from sunlight, it is important to improve the efficiency at which light energy is converted to electrical energy. In addition, sunlight contains light of multiple wavelengths and has a diverse range of planes of polarization. The antenna device explained below is able to provide particularly useful effects in such applications.

Figure 16:
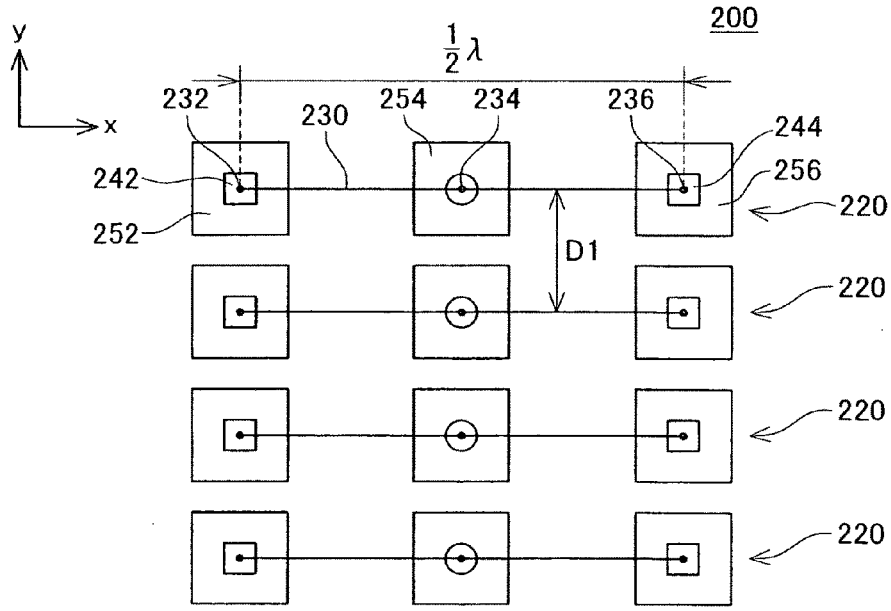
FIG. 16 shows an example of a layout of antenna elements.

An antenna device 200 shown in FIG. 16 has antenna elements 220 arranged in parallel. The amount of current that can be extracted can be increased by arranging a large number of the antenna elements 220 in rows. In addition, in adjacent antenna elements 220, a distance D1 between one linear antenna member 230 and another linear antenna member 230 is preferably equal to or less than the wavelength λ of light to be received. If the distance D1 is equal to or less than the wavelength λ of the light to be received, the amount of light that is transmitted to the rear of the antenna elements 220 can be inhibited, thereby making it possible to improve energy conversion efficiency.

Figure 17:
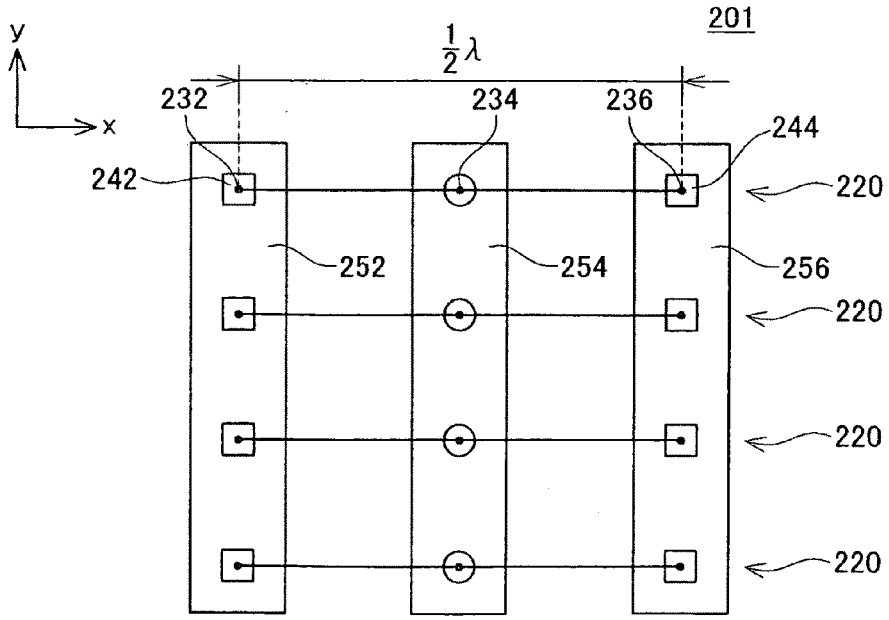
FIG. 17 shows another example of the layout of the antenna elements.

Alternatively, an antenna device 201 shown in FIG. 17 is such that the first connecting electrode 252, the fixed electrode 254 and the second connecting electrode 256 are extending between each antenna element 220. This antenna device 201 offers the advantage of not requiring complicated wiring.

Figure 18:
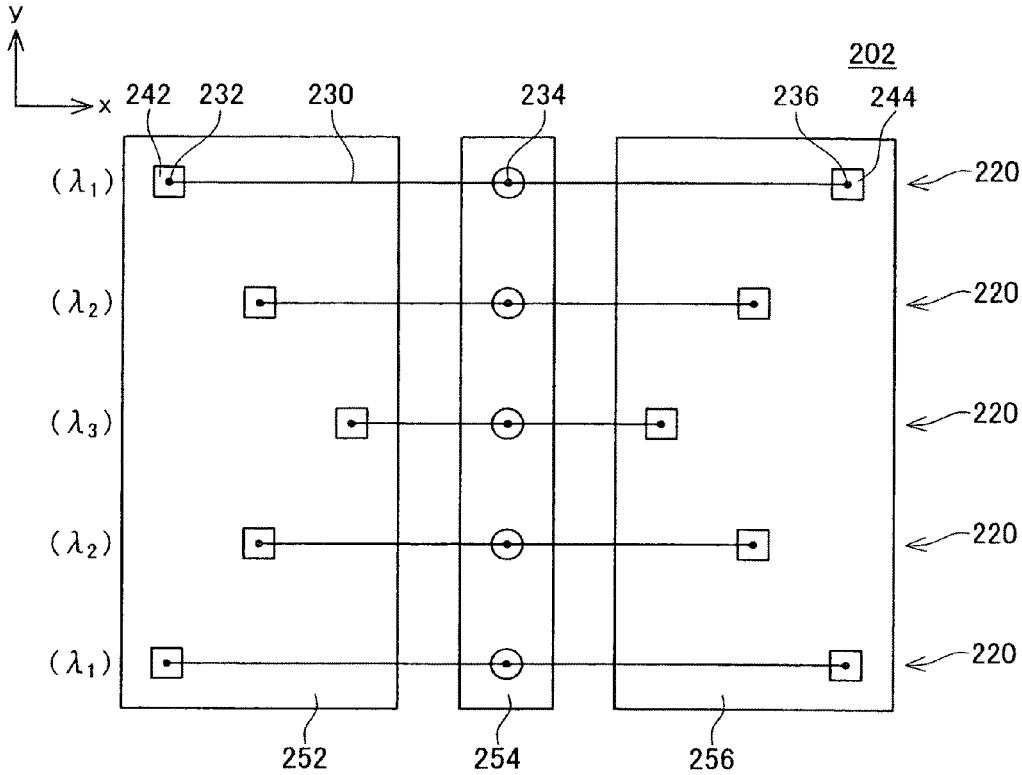
FIG. 18 shows another example of the layout of the antenna elements.

Alternatively, an antenna device 202 shown in FIG. 18 is used to receive light composed of a mixture of lights having a plurality of types of wavelengths (λ1, λ2, λ3). This antenna device 202 has a plurality of lengths for the lengths of the linear antenna members 230 in the longitudinal direction (the direction of the x axis). The presence of the linear antenna members 230 having different lengths makes it possible to receive lights of different wavelengths (λ1, λ2, λ3). This example is merely exemplary, and lights having a larger number of different wavelengths can be received by arranging linear antenna members 230 having a larger number of different lengths. The antenna device 202 can be applied to lights having a continuous width for wavelength. For example, after having divided a spectral distribution into n number of regions, the linear antenna members 230 may be arranged that have sensitivity to a typical wavelength of each divided spectrum. In addition, if the interval between linear antenna members 230 of adjacent antenna elements 220 is equal to or less than the wavelength of light for which the antenna elements 220 have sensitivity, not only light of a wavelength for which each antenna element 220 has sensitivity, but also lights having a continuous width for wavelength can be received since resonance occurs between adjacent antenna elements 220.

Figure 19:
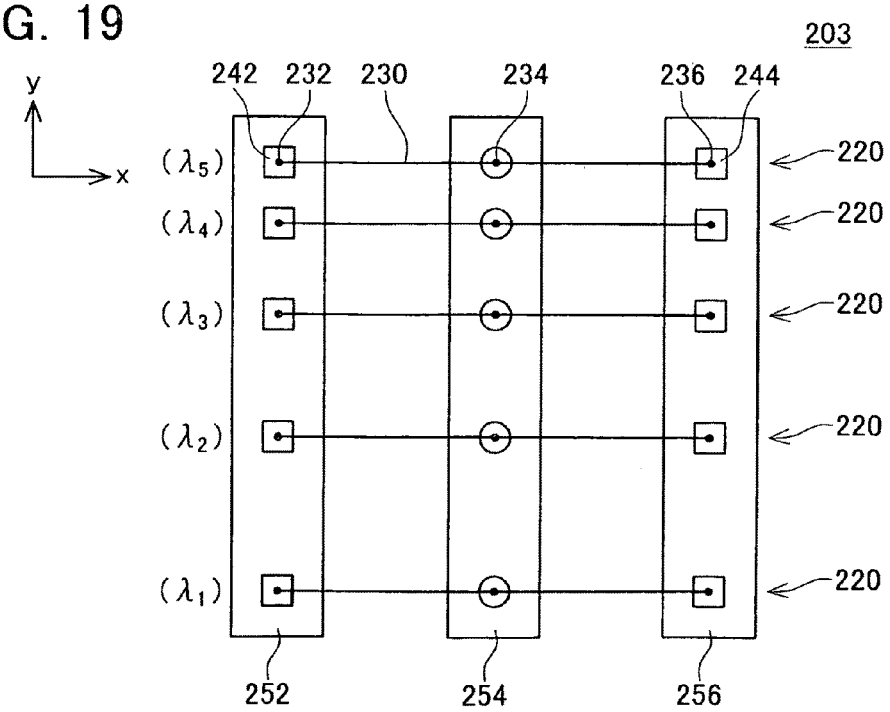
FIG. 19 shows another example of the layout of the antenna elements.

An antenna device 203 shown in FIG. 19 is also used to receive light composed of a mixture of lights having a plurality of types of wavelengths (λ1, λ2, λ3, λ4, λ5). The antenna device 203 has different intervals between the linear antenna members 230 of adjacent antenna elements 220. Changing the interval between the linear antenna members 230 of adjacent antenna elements 220 makes it possible to change the spatial resonance frequency, thereby enabling reception of lights having a plurality of types of wavelengths. The antenna device 203 has a simple structure, only requiring adjustment of the intervals between adjacent antenna elements 220.

Here, the above-mentioned antenna devices 200, 201, 202 and 203 indicated in FIGS. 16 to 19 are used to receive light in which the electric field has a single plane of vibration. Since the electric fields of sunlight have a diverse range of planes of vibration, it is preferable in terms of being able to efficiently receive such light, to be able to receive lights oriented in any arbitrary direction. In such cases, a transparent material may be used for the substrate, and the antenna devices 200, 201, 202 and 203 of FIGS. 16 to 19 may be formed on the front surface of that transparent substrate. Furthermore, the antenna devices 200, 201, 202 and 203 of FIGS. 16 to 19 are also preferably formed on the back surface of the transparent substrate. In addition, the longitudinal direction of antenna members 230 on the front surface and the longitudinal direction of antenna members 230 on the back surface preferably have a perpendicular relationship. Moreover, transparent material is preferably used for the connecting electrodes 252 and 256 and the fixed electrode 254. When configuring in this manner, among the lights that enter the surface of the transparent substrate, one with the electric field vector perpendicular to the longitudinal direction of the linear antenna members 230 on the surface passes through the substrate without being received by the antenna members 230 on the surface. The light that has passed therethrough can be received by the linear antenna members 230 on the back surface. In order to produce this type of composite antenna device, two of the antenna devices 200, 201, 202 and 203 shown in FIGS. 16 to 19 are prepared, and a substrate of one of the antenna devices 200, 201, 202 or 203 is laminated with a substrate of another antenna device 200, 201, 202 or 203 using a lamination technology. Alternatively, in order to produce this type of composite antenna device, the antenna devices 200, 201, 202 and 203 shown in FIGS. 16 to 19 may be formed on both sides of a single transparent substrate so that the linear antenna members 230 are mutually perpendicular.

A material such as quartz, glass with a high phase transition temperature, or clear alumina can be used for the material of the transparent substrate. A material such as indium-tin oxide or tin oxide can be used for the material of transparent electrodes. In addition, zinc oxide doped with a suitable metal such as aluminum or magnesium to adjust the electrical resistance thereof can also be used for the material of transparent electrodes. A method such as a lamination method that uses a transparent adhesive or an anodic bonding lamination method using an electric field can be used to laminate the transparent substrate. In addition, a direct bonding lamination method, in which the laminated surface of the substrate is modified with chemical groups that assist adhesion of the substrate, may also be used.

The following provides an explanation of another example of an antenna device that receives light having a plurality of polarization planes with reference to FIGS. 20 to 23.

Figure 20:
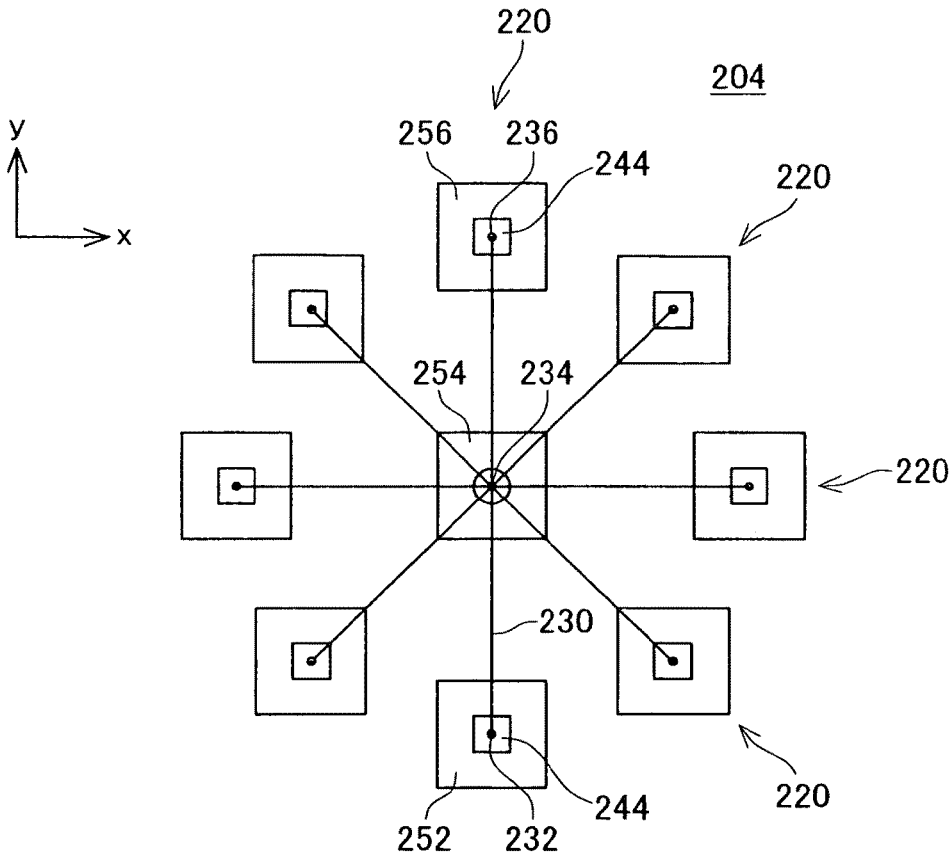
FIG. 20 shows another example of the layout of the antenna elements.

An antenna device 204 shown in FIG. 20 has the linear antenna members 230 extending radially towards the periphery with the fixed electrode 254 in the center. In this antenna device 204, a plurality of linear antenna members 230 is connected to a single fixed electrode 254. This antenna device 204 has superior surface area efficiency, since the surface area of fixed electrode 254 can be reduced.

Figure 21:
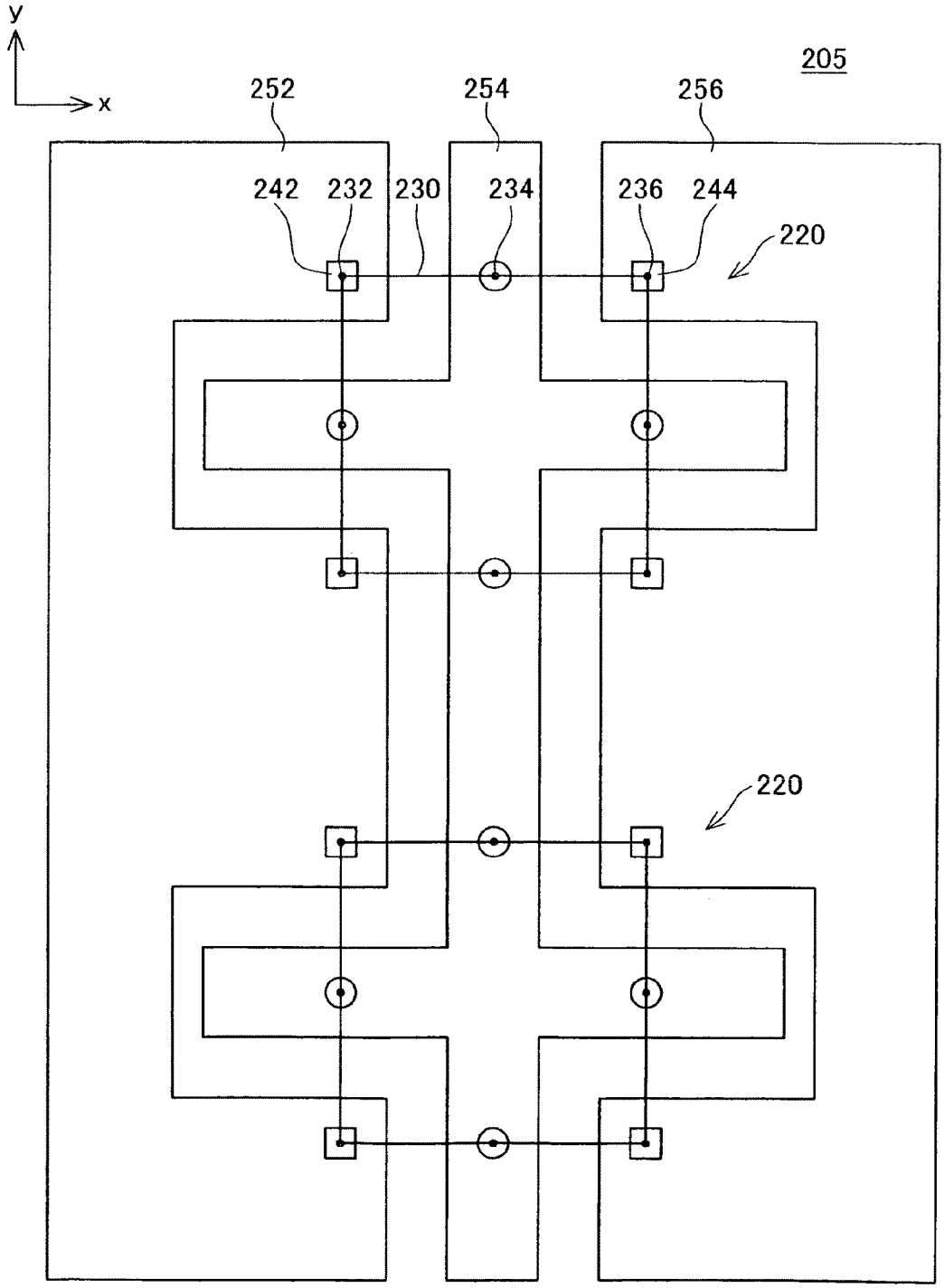
FIG. 21 shows another example of the layout of the antenna elements.

Alternatively, an antenna device 205 shown in FIG. 21 has linear antenna members 230 extending in different directions connected via the tunnel diodes 242 and 244. More specifically, the linear antenna members 230 extending in the direction of the x axis and the linear antenna members 230 extending in the direction of the y axis are connected via the tunnel diodes 242 and 244. In addition, the antenna device 205 is also characterized by the linear antenna members 230 forming a loop. In the antenna device 205, since the tunnel diodes 242 and 244 are also used for the purpose of connecting the linear antenna members 230 extending in the direction of the x axis and the linear antenna members 230 extending in the direction of the y axis, the number of parts can be reduced.

Figure 22:
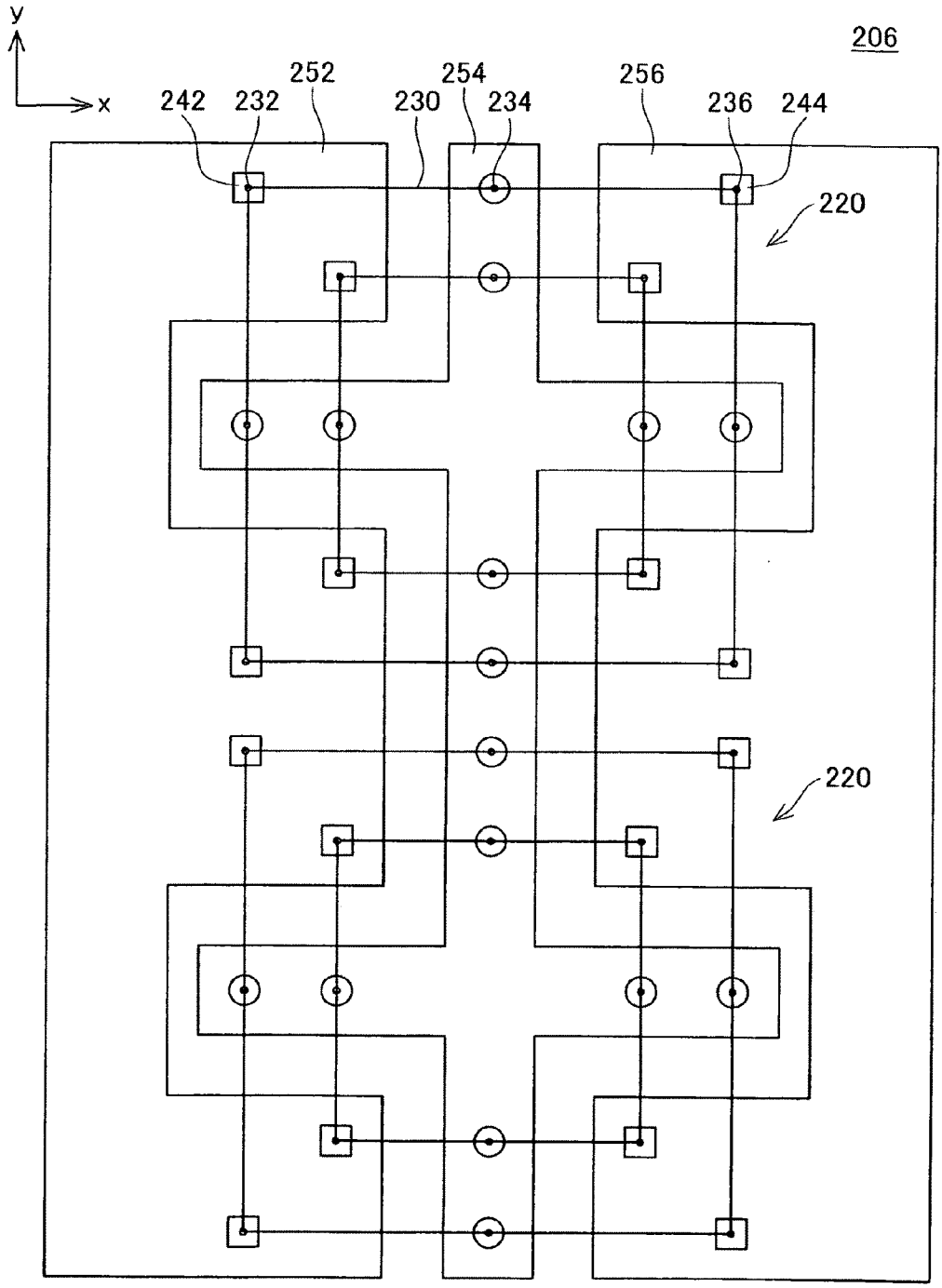
FIG. 22 shows another example of the layout of the antenna elements.
Figure 23:
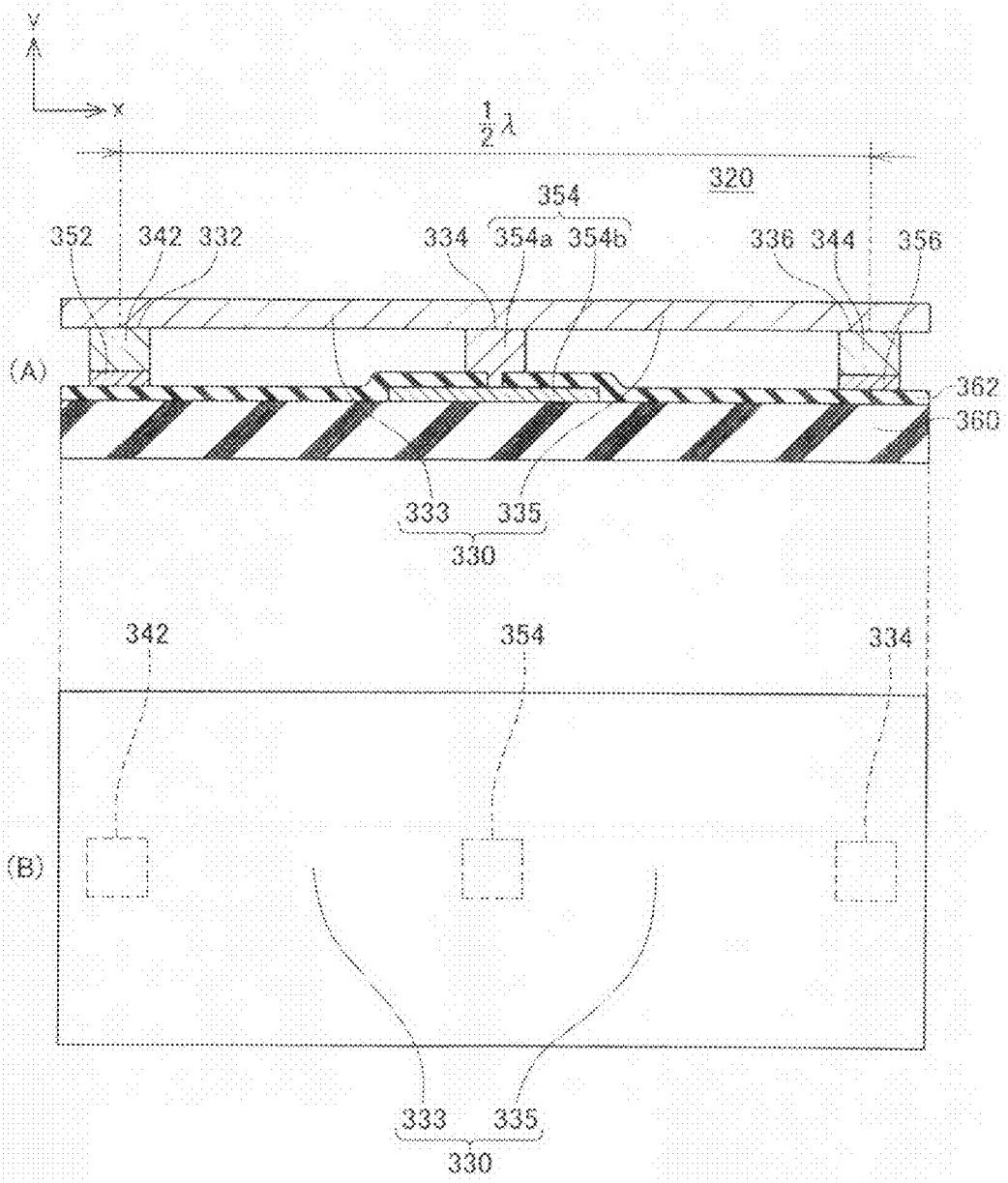
FIG. 23A schematically shows a cross-sectional view of an antenna element of a second example, while FIG. 23B schematically shows an overhead view of the antenna element of the second example.
Figure 24:
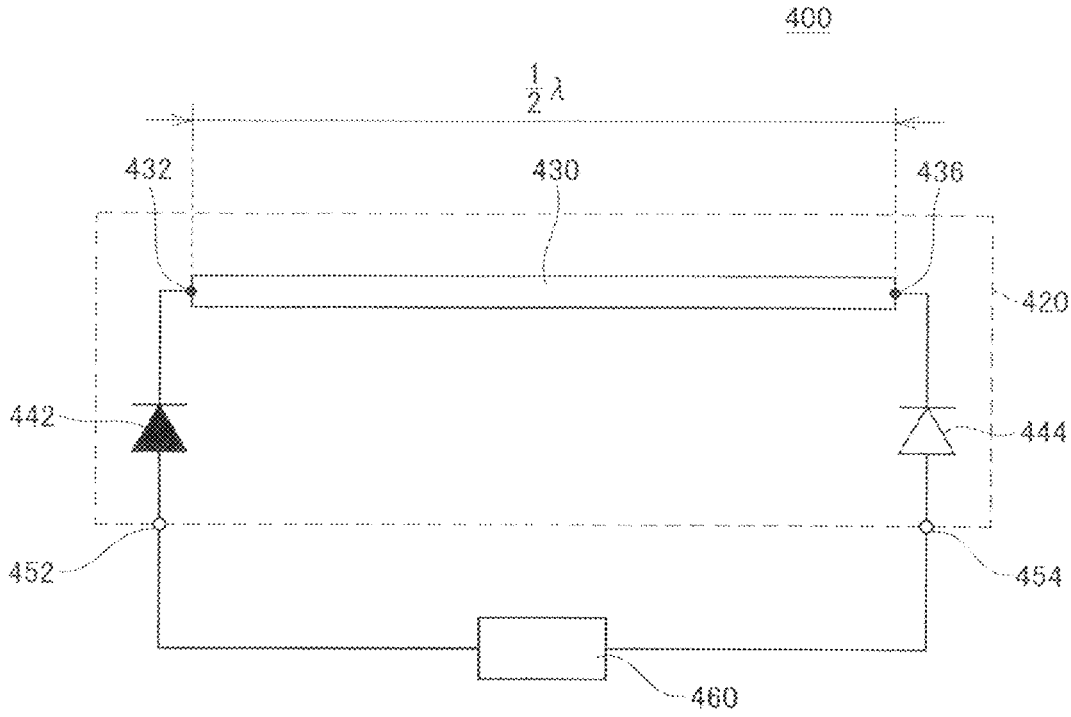
FIG. 24 PRIOR ART
FIG. 24 shows an example of the configuration of an antenna device of the prior art.
Figure 25:
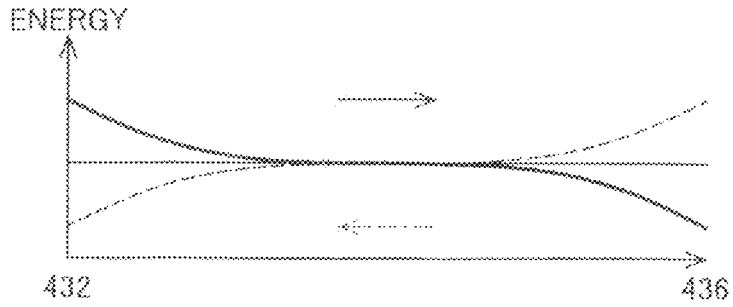
FIG. 25 PRIOR ART
FIG. 25 indicates the Fermi level within an antenna member of an antenna device of the prior art.
Figure 26:
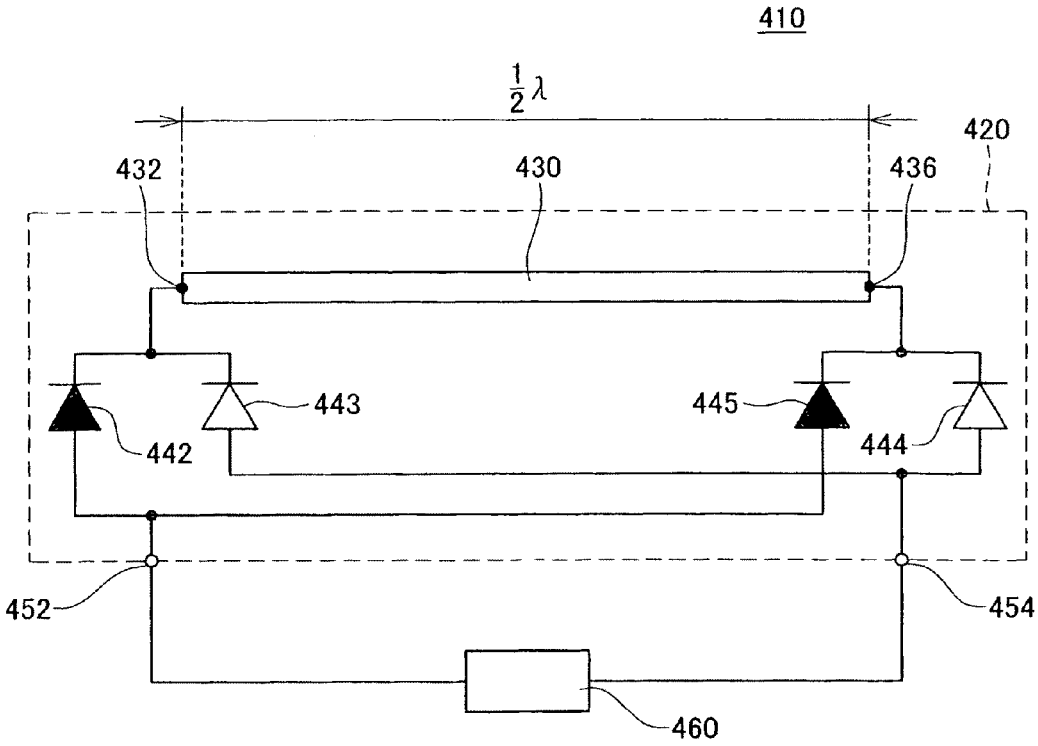
FIG. 26 PRIOR ART
FIG. 26 indicates another example of the configuration of an antenna device of the prior art.

An antenna device 206 shown in FIG. 22 has another linear antenna member 230 provided around the periphery of a linear antenna member 230 in the form of a loop so as to surround that linear antenna member 230. The antenna device 206 is able to receive lights having a plurality of polarization planes as well as lights having a plurality of wavelengths.

Example 2

FIGS. 23A and 23B show a configuration of an antenna element 320 provided in an antenna device of a second example. FIG. 23A schematically shows a longitudinal cross-sectional view of the antenna element 320. FIG. 23B schematically shows an overhead view of the antenna element 320. Furthermore, FIG. 23A is a longitudinal cross-sectional view taken along line A-A of FIG. 23B. The antenna element 320 is characterized by an antenna member 330 having the shape of a flat plate. Forms, structures and positional relationships in common with the first example can be applied for the other constituent members, and a detailed explanation thereof is omitted.

The antenna element 320 is provided with an insulating substrate 360, an insulating film 362 coated on the substrate 360, a first connecting electrode 352 provided on the surface of the insulating film 362, a fixed electrode 354 provided on the surfaces of the substrate 360 and the insulating film 362, a second connecting electrode 356 provided on the surface of the insulating film 362, a first tunnel diode 342 provided on the surface of the first connecting electrode 352, a second tunnel diode 344 provided on the surface of the second connecting electrode 356, and a flat antenna member 330.

The length of the antenna member 330 to the left and right as viewed in the drawing is set to ½ the wavelength λ of the light to be received. The antenna member 330 is provided with a first antenna member 333 and a second antenna member 335. The first antenna member 333 and the second antenna member 335 extend symmetrically with respect to a center portion 334 (which are examples of the second portion and the third portion) of the antenna member 330. The length of the first antenna member 333 and the second antenna member 335 to the left and right as viewed in the drawing is each set to ¼ the wavelength λ of the light. The first tunnel diode 342 contacts the back of one end 332 (example of the first portion) of the antenna member 330. The second tunnel diode 344 contacts the back of the other end 336 (example of the fourth portion) of the antenna member 330. The fixed diode 354 contacts the back of the center portion 334 of the antenna member 330. The fixed electrode 354 is provided with a first fixed electrode 354*a* and a second fixed electrode 354*b*. The first fixed electrode 354*a* and the second fixed electrode 354*b* are connected through a contact hole in the insulating film 362. The thickness of the second fixed electrode 354*b* is equal to or less than ¼ the wavelength λ of the light to be received. A load is respectively connected to the first connecting electrode 352 and the second connecting electrode 356. The fixed electrode 354 is fixed to a ground potential.

A sheet-like conductive carbon material is preferably used for the material of the flat antenna member 330. More specifically, highly oriented pyrolytic graphite (HOPG) or graphene can be used for the material of the flat antenna member 330. The flat antenna member 330 can be placed on the surface of the first tunnel diode 342, the fixed electrode 354 and the second tunnel diode 344, and can be adhered to the first tunnel diode 342, the fixed electrode 354 and the second tunnel diode 344 by heat treatment. The heat treatment may be carried out on the flat antenna member 330 while applying pressure as necessary.

The flat antenna member 330 is able to receive light of wavelength λ as a result of the plane of vibration of the electric field of the light to be received being parallel to the x axis. In addition, this flat antenna member 330 is also able to receive light in which the plane of vibration of the electric field is slightly inclined relative to the x axis. Consequently, the flat antenna member 330 is able to have a wider allowable range with respect to the plane of vibration of the electric field of the light to be received. Furthermore, in the antenna element 320, the first tunnel diode 342 and the second tunnel diode 344 are arranged along the direction of the x axis. However, instead of this example, the first tunnel diode 342 and the second tunnel diode 344 may also be arranged in the diagonal corners of the flat antenna member 330. According to this configuration, the light to be received can be received even in the form of circularly-polarized waves.

Specific embodiments of the present teachings are described above, but those merely illustrate some representative possibilities for utilizing the teachings and do not restrict the claims thereof. The subject matter set forth in the claims includes variations and modifications of the specific examples set forth above.

The technical elements disclosed in the specification or the drawings may be utilized separately or in all types of combinations, and are not limited to the combinations set forth in the claims at the time of filing of the application. Furthermore, the subject matter disclosed herein may be utilized to simultaneously achieve a plurality of objects or to only achieve one object.

What is claimed is:

1. An antenna device comprising:

a first connecting electrode configured to be connected to a fixed potential via a load;

a first tunnel diode having a pair of electrodes, one of the electrodes is being connected to the first connecting electrode;

a first antenna member having a conductive property and including a first portion and a second portion, the first portion being connected to the other electrode of the first tunnel diode; and a fixed electrode being connected to the second portion of the first antenna member and configured to be connected to the fixed potential, the fixed electrode having a conductor portion, the conductor portion being able to provide a mirror image antenna of the first antenna member.

2. The antenna device according to claim 1, further comprising:

a second connecting electrode configured to be connected to the fixed potential via the load;

a second tunnel diode having a pair of electrodes, one of the electrodes is being connected to the second connecting electrode; and a second antenna member having a conductive property and including a third portion and a forth portion, the third portion is being connected to the fixed electrode and the forth portion is being connected to the other electrode of the second tunnel diode, wherein:

the first, second, third and forth portions are arranged along a straight line, and a distance between the first and second portions is equal to a distance between the third and forth portions.

3. The antenna device according to claim 2, wherein:

the first antenna member extends along the straight line and has a length equal to one-fourth of a wave length of a light to be received by the first and second antenna members, the second antenna member extends along the straight line and has the length, and the first and second antenna members are integrally formed to compose an integral antenna member.

4. An antenna device comprising:

a plurality of the antenna devices according to claim 3, wherein:

each of distances between the first and forth portions of the plurality of integral antenna members differs from each other.

5. An antenna device comprising:

a plurality of the antenna devices according to claim 3, wherein a distance between a pair of integral antenna members fabricated next to each other differs from a distance between another pair of integral antenna members fabricated next to each other.

6. An antenna device comprising:

a plurality of antenna devices according to claim 3, wherein the plurality of integral antenna members includes a first group extending along a first direction and a second group extending along a second direction that is different from the first direction.

7. The antenna device according to claim 3, wherein the integral antenna member includes a carbon material.

8. The antenna device according to claim 7, wherein a kind of the carbon material is a carbon nanotube.

9. The antenna device according to claim 2, wherein the first antenna member and the second antenna member are integrally formed to compose a plane antenna member, and the second and third portions share a common portion within the plane antenna member.

10. The antenna device according to claim 9, wherein the first and forth portions are arranged at corners in the plane antenna member, the corners are being diagonal corners.

11. The antenna device according to claim 9, wherein the plane antenna member includes a carbon material.

12. The antenna device according to claim 11, wherein a kind of the carbon material is a graphene.

13. The antenna device according to claim 2, further comprising:

a substrate having an insulating property, wherein:

the first and second connecting electrodes and the fixed electrode are fabricated on a surface of the substrate, the first tunnel diode is fabricated on a surface of the first connecting electrode, and the second tunnel diode is fabricated on a surface of the second connecting electrode.

14. The antenna device according to claim 13, wherein each of the first and second connecting electrodes is fabricated in a depressed area of the substrate.

15. The antenna device according to claim 14, wherein:

a distance between a surface of the depressed area on which the first connecting electrode is fabricated and the first antenna member is equal to or greater than one-forth of a wavelength of a light to be received by the first and second antenna members, and a distance between a surface of the depressed area on which the second connecting electrode is fabricated and the second antenna member is equal to or greater than one-forth of the wavelength.

16. The antenna device according to claim 13, further comprising:

plural pairs of the first and second antenna members, wherein:

at least one pair of the first and second antenna members is fabricated on a first surface of the substrate, and at least another pair of the first and second antenna members is fabricated on a second surface of the substrate, wherein the second surface is different from the first surface.

17. The antenna device according to claim 16, wherein a material of the substrate is transparent relative to a light to be received by the first and second antenna members.

18. The antenna device according to claim 1, wherein a cathode of the first tunnel diode is connected to the first portion of the first antenna member and an anode of the first tunnel diode is connected to the first connecting electrode.

19. The antenna device according to claim 2, wherein a cathode of the first tunnel diode is connected to the first portion of the first antenna member, an anode of the first tunnel diode is connected to the first connecting electrode, a cathode of the second tunnel diode is connected to the forth portion of the second antenna member, and an anode of the second tunnel diode is connected to the second connecting electrode.

20. An antenna device comprising:

a first connecting electrode configured to be connected to a fixed potential via a load;

a first tunnel diode having a pair of electrodes, one of the electrodes is being connected to the first connecting electrode;

a first antenna member having a conductive property and including a first portion and a second portion, the first portion being connected to the other electrode of the first tunnel diode;

a fixed electrode being connected to the second portion of the first antenna member and configured to be connected to the fixed potential;

a second connecting electrode configured to be connected to the fixed potential via the load;

a second tunnel diode having a pair of electrodes, one of the electrodes is being connected to the second connecting electrode; and a second antenna member having a conductive property and including a third portion and a forth portion, the third portion is being connected to the fixed electrode and the forth portion is being connected to the other electrode of the second tunnel diode, wherein:

the first, second, third and forth portions are arranged along a straight line, and a distance between the first and second portions is equal to a distance between the third and forth portions.

21. An antenna device comprising:

a first connecting electrode configured to be connected to a fixed potential via a load;

a first tunnel diode having a pair of electrodes, one of the electrodes is being connected to the first connecting electrode;

a first antenna member having a conductive property and including a first portion and a second portion, the first portion being connected to the other electrode of the first tunnel diode;

a fixed electrode being connected to the second portion of the first antenna member and configured to be connected to the fixed potential, wherein a cathode of the first tunnel diode is connected to the first portion of the first antenna member and an anode of the first tunnel diode is connected to the first connecting electrode.

* * * * *